US006174372B1

(12) United States Patent
Yoshinaga et al.

(10) Patent No.: US 6,174,372 B1
(45) Date of Patent: Jan. 16, 2001

(54) DUPLEX TYPE COATING APPARATUS

(75) Inventors: Hidetoshi Yoshinaga; Kazuto Ueda; Nobuaki Irie; Akiyoshi Hashimoto, all of Nara (JP)

(73) Assignee: Hirano Tecseed Co., Ltd., Nara (JP)

( * ) Notice: Under 35 U.S.C. 154(b), the term of this patent shall be extended for 0 days.

(21) Appl. No.: 09/015,020

(22) Filed: Jan. 29, 1998

(30) Foreign Application Priority Data

Feb. 4, 1997 (JP) ..... 9-012547

(51) Int. Cl.[7] ..... B05C 11/00

(52) U.S. Cl. ..... 118/695; 118/681; 118/674; 118/684

(58) Field of Search ..... 118/410, 411, 118/419, 683, 684, 405, 674, 669, 681, 692, 695; 427/209, 210, 8, 9; 239/581.1, 99

(56) References Cited

U.S. PATENT DOCUMENTS

| | | | | |
|---|---|---|---|---|
| 4,063,531 | | 12/1977 | Zitzow . | |
| 4,231,318 | * | 11/1980 | Zink | 118/122 |
| 4,245,584 | | 1/1981 | Kolosov et al. . | |
| 4,396,648 | * | 8/1983 | Holt et al. | 118/410 |
| 4,461,236 | * | 7/1984 | Langenbach | 118/410 |
| 4,774,109 | | 9/1988 | Hadzimihalis et al. . | |
| 4,806,183 | | 2/1989 | Williams . | |
| 4,844,004 | | 7/1989 | Hadzimihalis et al. . | |
| 5,145,528 | | 9/1992 | Watanabe et al. . | |
| 5,183,508 | * | 2/1993 | Cholinski . | |
| 5,447,566 | | 9/1995 | Loiacono . | |
| 5,458,913 | | 10/1995 | Tsunoda et al. . | |
| 5,558,716 | * | 9/1996 | Mitani et al. | 118/693 |
| 5,597,615 | | 1/1997 | Tsunoda et al. . | |
| 5,641,356 | | 6/1997 | Delmore et al. . | |
| 5,650,011 | | 7/1997 | Yoshinaga . | |
| 5,776,251 | | 7/1998 | Irie et al. . | |
| 5,843,230 | * | 12/1998 | Potjer et al. . | |
| 6,024,299 | * | 2/2000 | Drozkowski . | |

FOREIGN PATENT DOCUMENTS

| | | |
|---|---|---|
| 3-72976 | 3/1991 | (JP) . |

* cited by examiner

*Primary Examiner*—Brenda A. Lamb
(74) *Attorney, Agent, or Firm*—Jordan and Hamburg LLP

(57) ABSTRACT

A pair of left and right dies 12 and 14 are installed on both sides of a transfer path of a web 7 and ejection paths 30 of coating solution are made freely openable and closable by installing rotary valves 37 at insides of the dies 12 and 14 by which when coated portions and uncoated portions are successively formed, intermittent coating can be carried out by swiftly forming these portions.

19 Claims, 17 Drawing Sheets

DUPLEX TYPE COATING APPARATUS

BACKGROUND OF THE INVENTION

The present invention relates to a duplex type coating apparatus capable of simultaneously coating both faces of a web of cloth, plastic film, metal sheet, or glass plate, which are in an elongated shape, or a metal sheet in a net-like shape, a porous metal sheet or the like with a coating solution.

Recently, with the increased use of portable telephones and portable information terminals, mass production of lithium cells of a spiral electrode type has been actively carried out. Further, it is necessary in mass production of the lithium cells to carry out so-called intermittent coating in which coated portions and uncoated portions are alternately formed on strip-like hoop material (that is, a web) of a copper foil or an aluminum foil in a length direction of the web by a slurry clad material (that is, a coating solution) composed mainly of an electrode activating substance and further, it is necessary to coat the coating solution at the same position on both faces of the web.

Hence, the applicant has previously proposed a coating apparatus capable of coating a coating solution on both faces of a web (Japanese Unexamined Patent Publication No. JP-A-8-206567). The coating apparatus is installed with a pair of dies on both sides of a transfer path of a web. A solution reservoir for the coating solution and an ejection port for the coating solution are provided in the die and the coating solution is coated on both faces of the web from the ejection ports by supplying the coating solution to the reservoirs. In this case, the ejection port is formed by a fixed lip portion and a movable lip portion and the movable lip portion is arranged to be movable in the up and down direction by an air cylinder by which the ejection port can be opened or closed.

When the intermittent coating is carried out by the coating apparatus, the web is moved along the transfer path and the coating solution is ejected from the pair of dies. Further, when a coated portion is to be formed, the ejection port is brought into a state of being opened by moving the movable lip portion to thereby eject the coating solution. When an uncoated portion is to be formed, the ejection port is brought into a state of being closed by moving the movable lip portion using the air cylinder. Thereby, the coating solution does not come out from the ejection port and therefore, the uncoated portions can be formed on the both faces of the web.

The above-described coating apparatus is provided with a structure in which the movable lip portion is operated by the air cylinder and therefore, there is a problem in that the response time of the operation of the movable lip portion is limited and an interval between the uncoated portions or the coated portions cannot be reduced to less than a certain amount.

Further, as shown by FIG. 17, when coated portions 7*a*, and uncoated portions 7*b* are alternately formed on a web 7, there causes a phenomenon in which an amount of a coating solution that is larger than that of other portion is coated and the coated portion is swollen at a position 7*d* of the coated portion 7*a* where the coating is started and a position 7*e* thereof where the coating is finished.

SUMMARY OF THE INVENTION

Accordingly, in view of the above-described problem, it is an object of the present invention to provide a duplex type coating apparatus for forming coated portions and uncoated portions successively whereby an intermittent coating can be carried out by swiftly forming the uncoated portions and the coated portions flat throughout.

According to the present invention, there is provided a coating apparatus of a duplex type comprising a pair of dies installed on both sides of a transfer path of a web, reservoirs for a coating solution in the respective dies, ejection ports installed at front end portions of the respective dies along a width direction of the web for ejecting the coating solution, ejection paths for the coating solution reaching the ejection ports from the reservoirs, coating solution supplying means for supplying the coating solution to the respective reservoirs whereby the coating solution is coated on both faces of the web by ejecting same amounts of the coating solution respectively from the pair of ejection ports to the running web, rotary valves, in each of which a valve element has a substantially cylindrical shape and is in parallel to a width direction of the dies and arranged at midways of the ejection paths, and driving means for pivoting the rotary valves.

According to a further feature of the present invention, there is provided the coating apparatus described above, wherein the driving means open and close the ejection paths by repeatedly rotating clockwise and counterclockwise the valve elements.

According to a further feature of the present invention, there is provided the coating apparatus described above, wherein each of the valve elements has a substantially cylindrical shape and is formed with a flow path portion by notching a portion of a circumferential portion of the valve element along an axial direction.

According to a further feature of the present invention, there is provided the coating apparatus as described above, wherein an interval between the pair of dies is made variable by installing die moving means for moving at least one of the pair of dies in a direction orthogonal to the transfer path.

According to a further feature of the present invention, there is provided the coating apparatus as described above, wherein the driving means for pivoting the rotary valves installed to the pair of dies are installed to the pair of rotary valves respectively individually, and wherein different intermittent coatings are carried out respectively on the faces of the web by individually varying timings for opening and closing the ejection paths at the pair of rotary valves by individually operating the pair of driving means.

According to a further feature of the present invention, there is provided the coating apparatus as described above, wherein ejection spaces capable of ejecting the coating solution and block members for blocking ejection of the coating solution are formed alternately along the width direction of the web.

According to a further feature of the present invention, there is provided the coating apparatus as described above, further comprising transfer speed detecting means for detecting a transfer speed V of the web, constant amount pumps for supplying same amounts of the coating solution at a constant ejection amount per rotation respectively to the reservoirs of the pair of dies, and control means for controlling a rotational number N of the constant amount pumps in accordance with the transfer speed V from the transfer speed detecting means to satisfy the equation $$N=(D\times W\times V)/(K1\times Q),$$

wherein notation D designates a set coated thickness in a wet state, notation W designates a set coated width of the web, notation Q designates the ejection amount per rotation of the constant amount pump and notation K1 designates a constant.

According to a further feature of the present invention, there is provided the coating apparatus as described above, further comprising transfer speed detecting means for detecting a transfer speed V of the web, constant amount pumps for supplying same amounts of the coating solution at a constant ejection amount per rotation respectively to the reservoirs of the pair of dies, coated thickness detecting means for detecting an averaged coated thickness Dp with respect to the width direction of the web, and control means for controlling a rotational number N of the constant amount pumps in accordance with, the transfer speed V from the transfer speed detecting means and the averaged coated thickness Dp from the coated thickness detecting means to satisfy the equation $$N=(Ds\times V\times K0)/Dp,$$

wherein Ds designates the set coated thickness in a wet state and notation K0 designates a constant.

According to a further feature of the present invention, there is provided the coating apparatus as described above, further comprising pressure measuring means for measuring an internal pressure of the reservoirs, constant amount pumps for supplying same amounts of the coating solution at constant ejection amounts per rotation respectively to the reservoirs of the pair of dies, and control means for reducing a rotational number of the constant amount pumps such that the rotary valves are rotated from an opened state to a closed state and the pressure detected by the pressure measuring means is made constant.

According to a further feature of the present invention, there is provided the coating apparatus as described above, further comprising pressure measuring means for measuring an inner pressure of the reservoirs, constant amount pumps for supplying same amounts of the coating solution at a constant ejection amount per rotation respectively to the reservoirs of the pair of dies, and control means for increasing a rotational number of the constant amount pumps such that when the rotary valves are rotated from a closed state to an opened state, the pressure detected by pressure measuring means is made constant.

Operation of the coating apparatus is now described below. The web is transferred along the transfer path. The same amounts of the coating solution are ejected from the ejection ports of the pair of dies on both faces of the web.

In this case, the ejection paths are opened and closed by pivoting the rotary valves, installed in the midways of the ejection paths, by the driving means. When the ejection paths are brought into an opened state, the coating solution is ejected from the ejection ports and when the ejection paths are brought into a closed state, the ejection of coating solution from the ejection ports is stopped. Accordingly, coated portions and uncoated portions are alternately formed on both faces of the web by which the intermittent coating can be carried out.

According to a feature of the invention, the ejection paths are opened and closed by repeatedly rotating clockwise and counterclockwise the valve elements. Opening and closing of the ejection paths can be carried out swiftly since the ejection paths are not constructed to open or close by rotating the valve elements one rotation.

When the valve elements having a substantially cylindrical shape, in the case where the flow path portions coincide with the ejection paths, the coating solution flows and the ejection of the coating solution is stopped in other state.

According to the coating device of the present invention, at least one die of the pair of dies can be moved by the die moving means and accordingly, the interval between the pair of dies can be changed.

Therefore, webs having different thicknesses can be accommodated. Further, when there is a seam on the web, provisions are made so that the seam portion runs smoothly between the pair of dies by increasing the interval between the pair of dies using the die moving means.

According to the coating apparatus of the present invention, the driving means are installed respectively to the rotary valves and accordingly, different intermittent coatings can be carried out on both faces of the web by changing timings of opening and closing the ejection paths by respectively changing the state of operating the rotary valves using the driving means.

According to a coating apparatus of the present invention, ejection spaces and block members are formed in the ejection paths alternately along the width direction of the web and accordingly, not only striped coating but also patch coating can be carried out on the faces of the web.

According to a coating apparatus of the present invention, the rotational number N of the constant amount pumps is controlled by a control means to satisfy the equation $$N=(D\times W\times V)/(K1\times Q).$$

Then, a constant amount of the coating solution necessary for the set coated thickness of the web is always supplied from the constant amount pumps. Therefore, the coating solution can be coated on both faces of the web always with the same coated thickness.

According to a coating apparatus of the present invention, the rotational number N of the constant amount pumps is controlled by a control means to satisfy the equation $$N=(DS\times V\times K0)/Dp.$$

Then, a constant amount of the coating solution necessary for the coated thickness of the web is supplied from the constant amount pumps. Accordingly, the coated amounts of the web are always the same and uniform on both faces.

According to a coating apparatus of the present invention, the rotational number of the constant amount pumps is reduced such that when the rotary valves are rotated from an opened state to a closed state, the pressure detected by the pressure measuring means is maintained constant and accordingly, the phenomenon where an amount of the coating solution larger than that of a remaining portion is coated at a position of the coated portion where the coating is finished, and the coated portion is thus swollen, does not occur.

According to a coating apparatus of the present invention, the rotational number of the constant amount pumps is increased such that when the rotary valves are rotated from a closed state to an opened state, the pressure detected by the pressure measuring means is maintained constant and accordingly, a phenomenon where an amount of the coating solution larger than that of another portion is coated at a position of the coated portion where the coating is started, and the coated portion is thus swollen, does not occur.

BRIEF DESCRIPTION OF THE INVENTION

DETAILED DESCRIPTION OF THE INVENTION

A coating apparatus 10 of a duplex type according to a first embodiment of the present invention is described with reference to FIG. 1 through FIG. 10 as follows. Herein upper and lower as well as left and right indicate upper, lower, left and right in FIG. 1, FIG. 2, FIG. 5, FIG. 7 and FIG. 8. Further, the surface to rear face direction of these drawings is the forward to rearward direction. Further, the forward to rearward direction is a width direction of the web 7.

Figure 1:
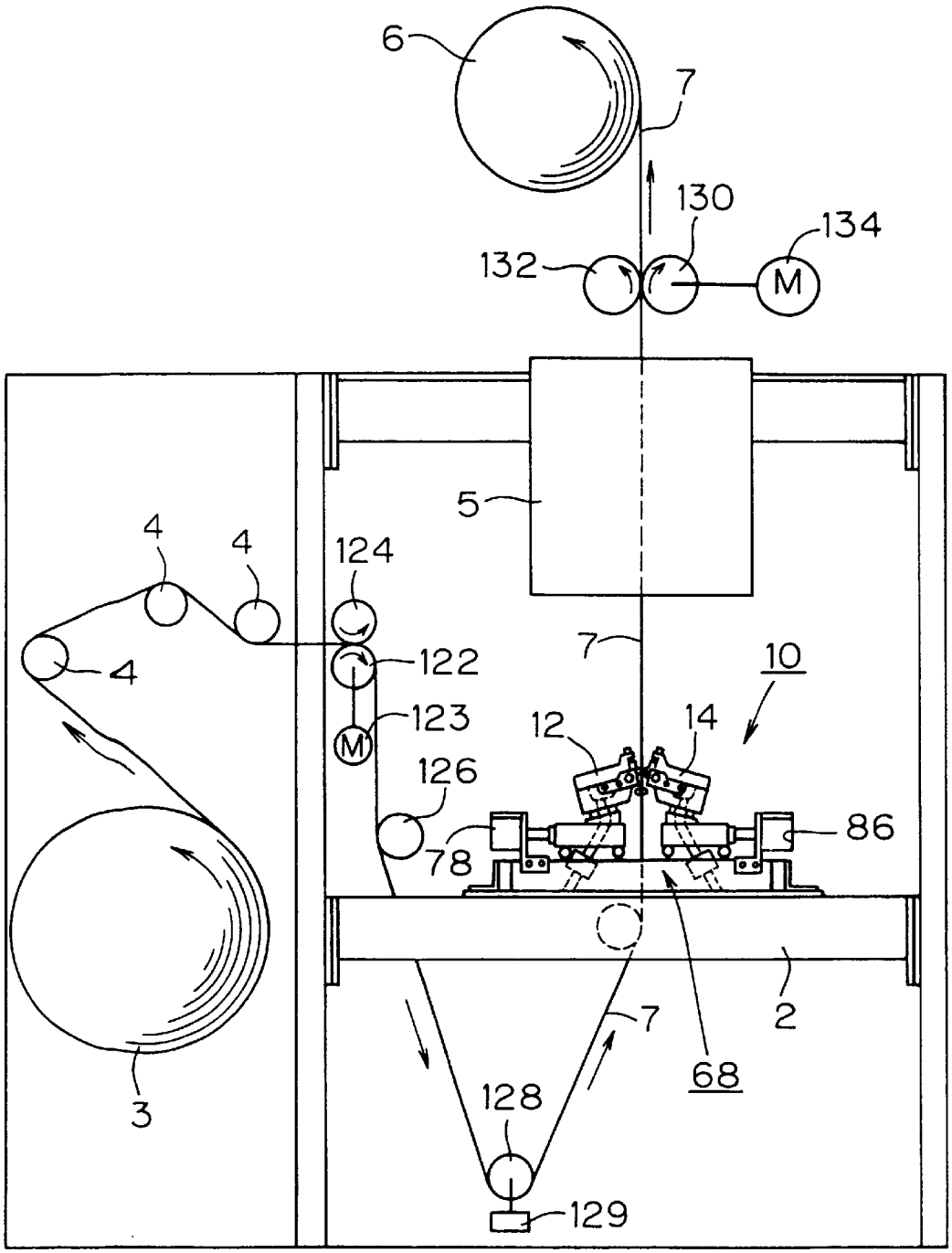
FIG. 1 is a side view showing a coating system that is one embodiment of the present invention.

An overall structure of a coating system 1 includes the coating apparatus 10 in FIG. 1.

Notation 2 designates an installation base for installing the coating apparatus 10.

Notation 3 designates a lead-out roll for winding and storing a web 7.

Notation 4 designates three guide rollers for guiding the web 7 from the lead-out roll to an in-feed roller.

Notation 122 designates the in-feed roller, notation 123 designates an in-feed motor for driving the in-feed roller 122, and notation 124 designates a nip roller installed opposite the in-feed roller 122.

Notation 126 designates a guide roller for guiding the web 7 transferred from the in-feed roller 122 to a tension roller.

Notation 128 designates the tension roller installed on the lower side of the coating apparatus 10, to which a tension measuring apparatus 129 for measuring tension of the web 7 is installed. Further, the web 7 is transferred to the coating apparatus 10 after passing the tension roller 128.

Notation 5 designates a drying apparatus installed on the upper side of the coating apparatus 10. The drying apparatus 5 dries the web 7 coated with a coating solution 8 by ejecting hot air thereto.

Notation 130 designates an out-feed roller, notation 134 designates an out-feed motor for driving the out-feed roller 130, and notation 132 designates a nip roller installed opposite the out-feed roller 130.

Notation 6 designates a store roll for winding the web 7, which has been processed by the drying apparatus 5.

Referring to FIGS. 2–7 reference designators 12 and 14 designate a pair of left and right dies for coating the coating solution 8 on the web 7, the web 7 moves on a transfer path between the pair of dies 12 and 14 in the vertical direction from below to above and the coating solution 8 is ejected from ejection ports 32 of the dies 12 and 14 respectively onto both faces of the web 7. The widths of the pair of dies 12 and 14 are respectively formed with a size substantially the same as the width of the web 7.

The structure of the pair of left and right dies 12 and 14 is described with reference to the die 12 on the left side since the dies 12 and 14 are symmetrical with respect to left and right directions.

The die 12 on the left side is formed by an upper member 16 and a lower member 18 such that it can be divided into an upper and a lower portion. The lower member 18 is formed to taper down toward the direction to the transfer path, that is, to the right side.

A recess portion is formed in the upper face of the lower member 18 and defines a solution reservoir 22. An inclined face is formed on the right side of the reservoir 22 and the volume is reduced toward the right side. Further, a flow inlet 20 of the coating solution 8 penetrates the left side of the lower face of the reservoir 22. The flow inlet 20 is connected with a hose 52 for supplying the coating solution from a constant amount pump described below.

Figure 6:
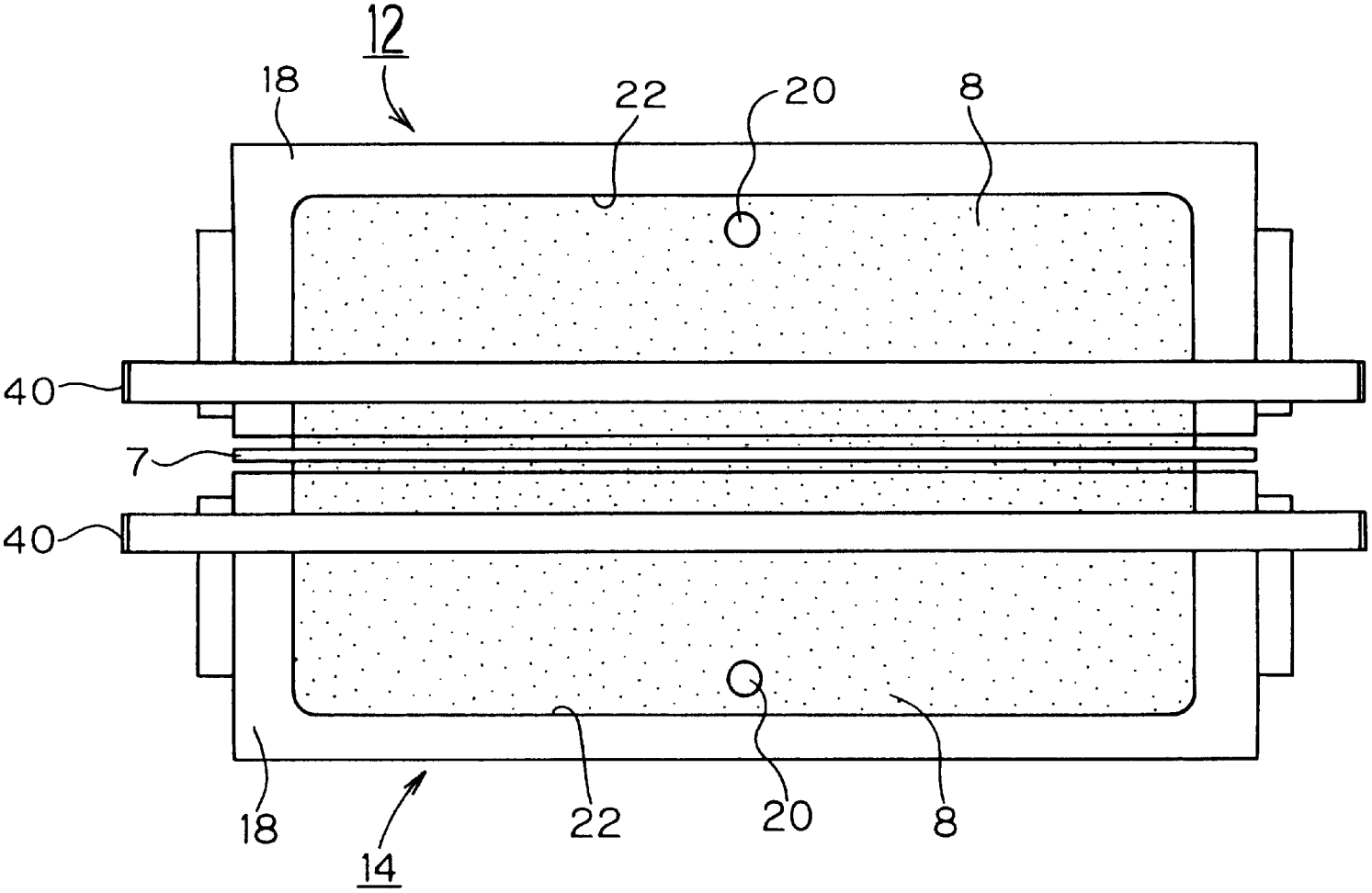
FIG. 6 is a plan view of lower members.

As shown by FIG. 6, the planar shape of the reservoir 22 has a contour following an outer shape of the lower member 18. Further, the flow inlet 20 is installed at its central portion. However, the shape of the reservoir 22 may be formed in a fan shape to diverge from the flow inlet 20 to both sides.

The upper member 16 covers the lower member 18 and the upper member 16 and the lower member 18 are fixed by a plurality of fixing bolts 24. The upper member 16 is formed by an upper member main body 26 that is a portion covering the reservoir 22 of the lower member 18 and a front end member 28 installed separately on the right side of the main body. A space formed by a right side lower face of the upper member main body 26, a lower face of the front end member 28 and a right side upper face of the lower member 18, forms an ejection path 30. The right end portion of the ejection path 30 forms the ejection port 32. A pressure sensor 50 for adjusting pressure of the reservoir 22 is installed in the upper member 26.

The right end portions of the lower member 18 and the front end member 28 both defining the ejection port 32 form a lip structure which is projected similar to lips of a person. Further, the right end portion of the lip structure, that is, a right end face 34 of the lower member 18 and a right end face 36 of the front end member 28 are parallel to the web 7.

A rotary valve 37 is installed at a portion of the ejection path 30 formed by the lower member 18 and the upper member main body 26. A hole having a circular section is formed between the upper member main body 26 and the lower member 18 along the width direction of the die 12. The hole forms a valve cylinder 38 of the rotary valve 37.

Figure 7:
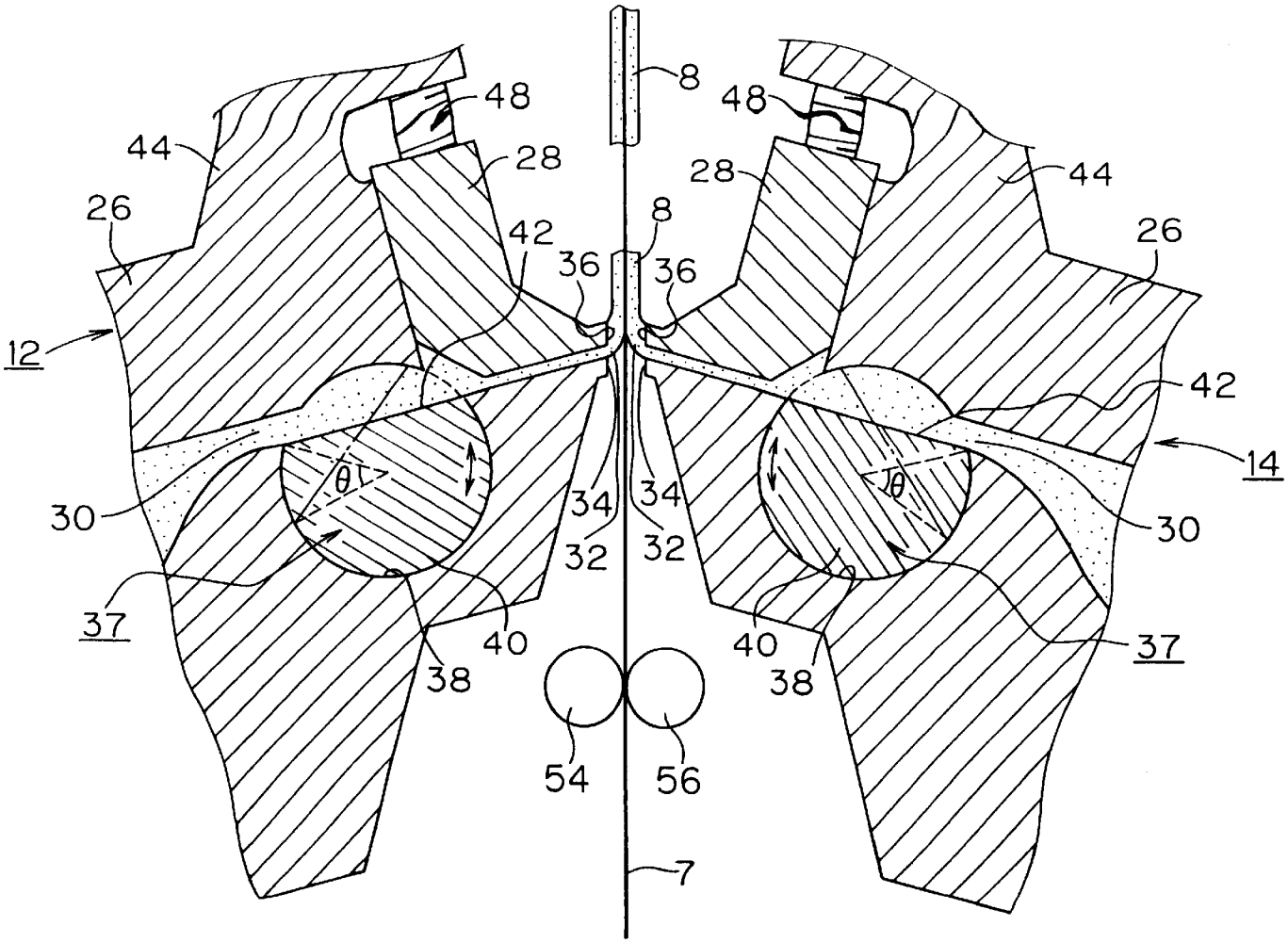
FIG. 7 is a cross-sectional view magnifying portions of ejection ports of the pair of left and right dies.

A valve element 40 for opening and closing the ejection path 30 is arranged in the valve cylinder 38. As shown by FIG. 7, the valve element 40 is formed in a cylindrical shape, the upper portion of which is notched along the axial direction by which a flow path portion 42 is formed. Further, the valve element 40 is extends from left and right side portions of the die 12.

The front end member 28 is attached to the upper member main body 26. A support portion 44 is projected from the upper face of the right end portion of the upper member main body 26 in the right upward direction. The front end member 28 is arranged to be brought into contact with the right end portion of the upper member main body 26 and is fixed thereto by bolts 46. Further, although the bolts and the screw holes of the upper member main body 26 engage securely, the diameter of the screw holes of the front end member 28, through which the bolts 26 penetrate, is provided with more or less allowance compared with that of the screw portions of the bolts 46 so the front member 28 can be moved upwardly and downwardly with respect to the upper member main body 26.

Further, a plurality of adjusting bolts 48 are brought into contact with the upper face of the front end member 28 from the support portion 44 projected from the upper member main body 26 along the width direction of the die 12. By adjusting the adjusting bolts 48, the front end member 28 can be moved upwardly and downwardly.

Although the front end member 28 is installed at all the portions along the width direction of the die 12 and forms the ejection port 32, when the magnitude of the ejection port 32, that is, a distance between the right end portion of the lower member 34 and the right end portion of the front end member 28 is not uniform in the width direction, the same amount of coating cannot be carried out with respect to the web. However, more or less warp exists along the width direction of the front end member 28, which is formed of a metal, and therefore, there the magnitude of the ejection port 32 can differ due to the warp depending on the position along the width direction. Accordingly, in order to carry out the adjustment, the warp of the front end member 28 is adjusted by the adjusting bolts 48.

Further, the die 14 on the right side is formed symmetrical to the die 12 on the left side explained above with respect to the left and right direction.

Further, a pair of guide rollers 54 and 56 are installed on both sides of the lower portion of the transfer path disposed between the pair of dies 12 and 14. The pair of guide rollers 54 and 56 are provided to transfer the web 7 in the vertical direction.

Figure 3:
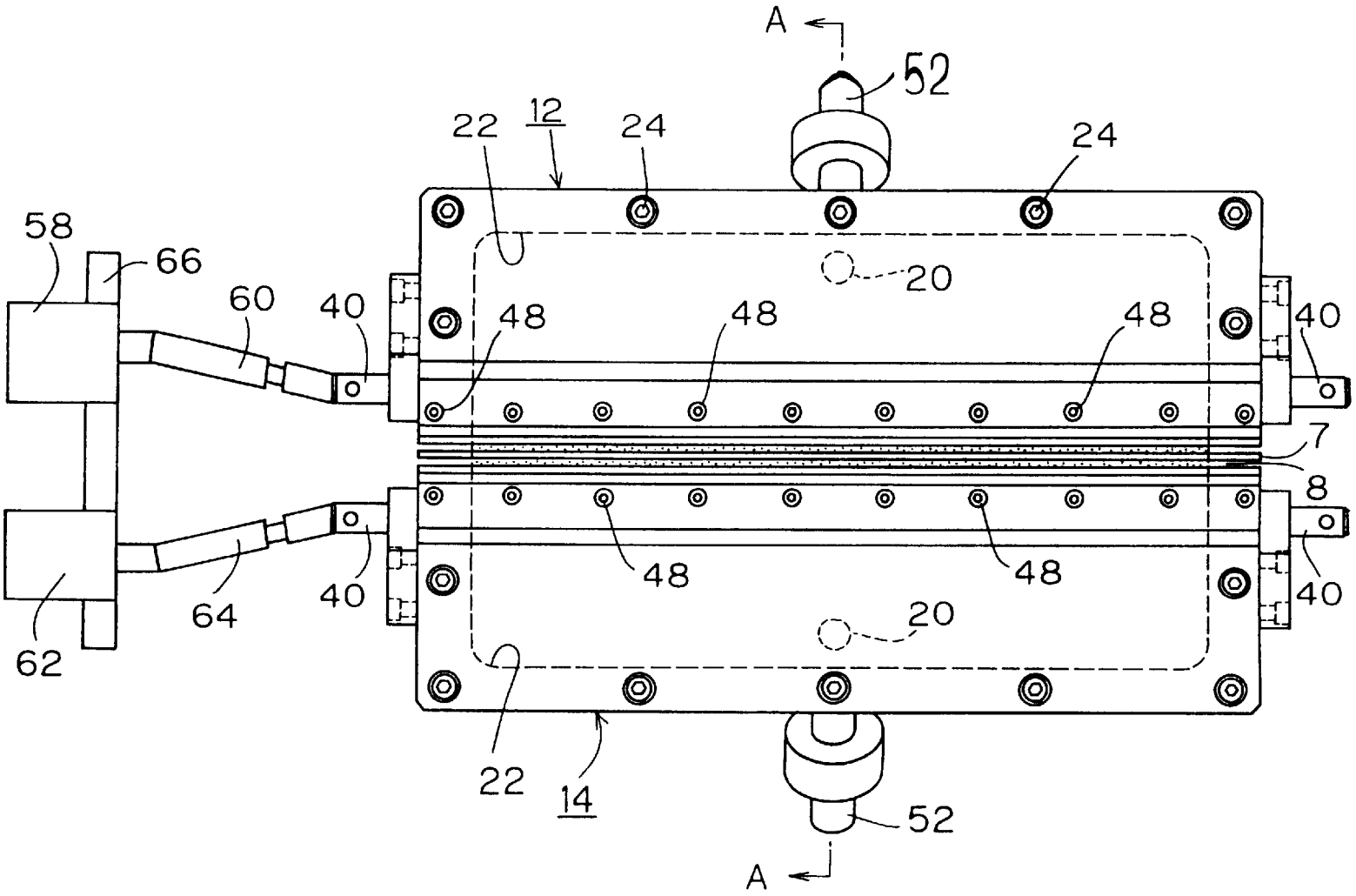
FIG. 3 is a plan view of a pair of left and right dies.
Figure 4:
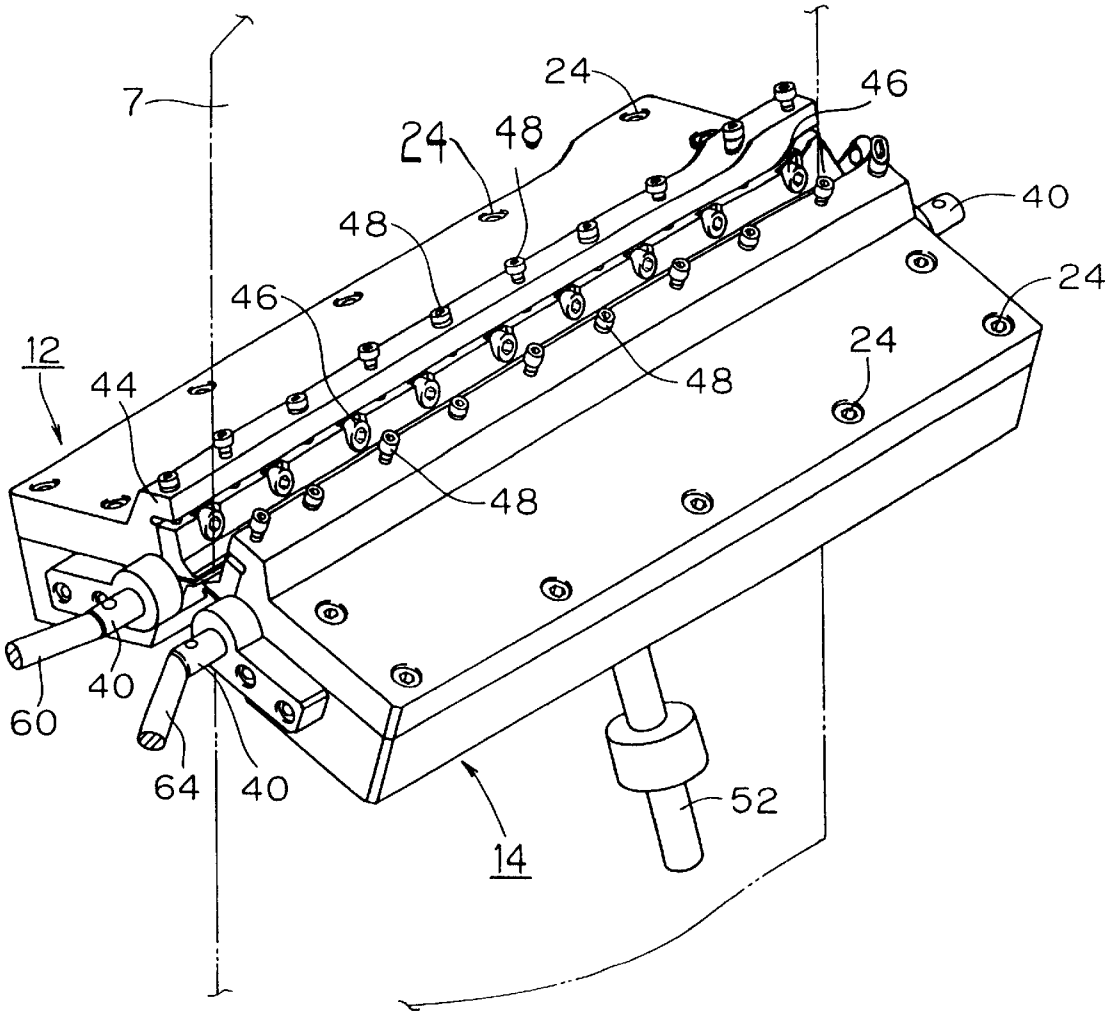
FIG. 4 is a perspective view of the pair of left and right dies.
Figure 5:
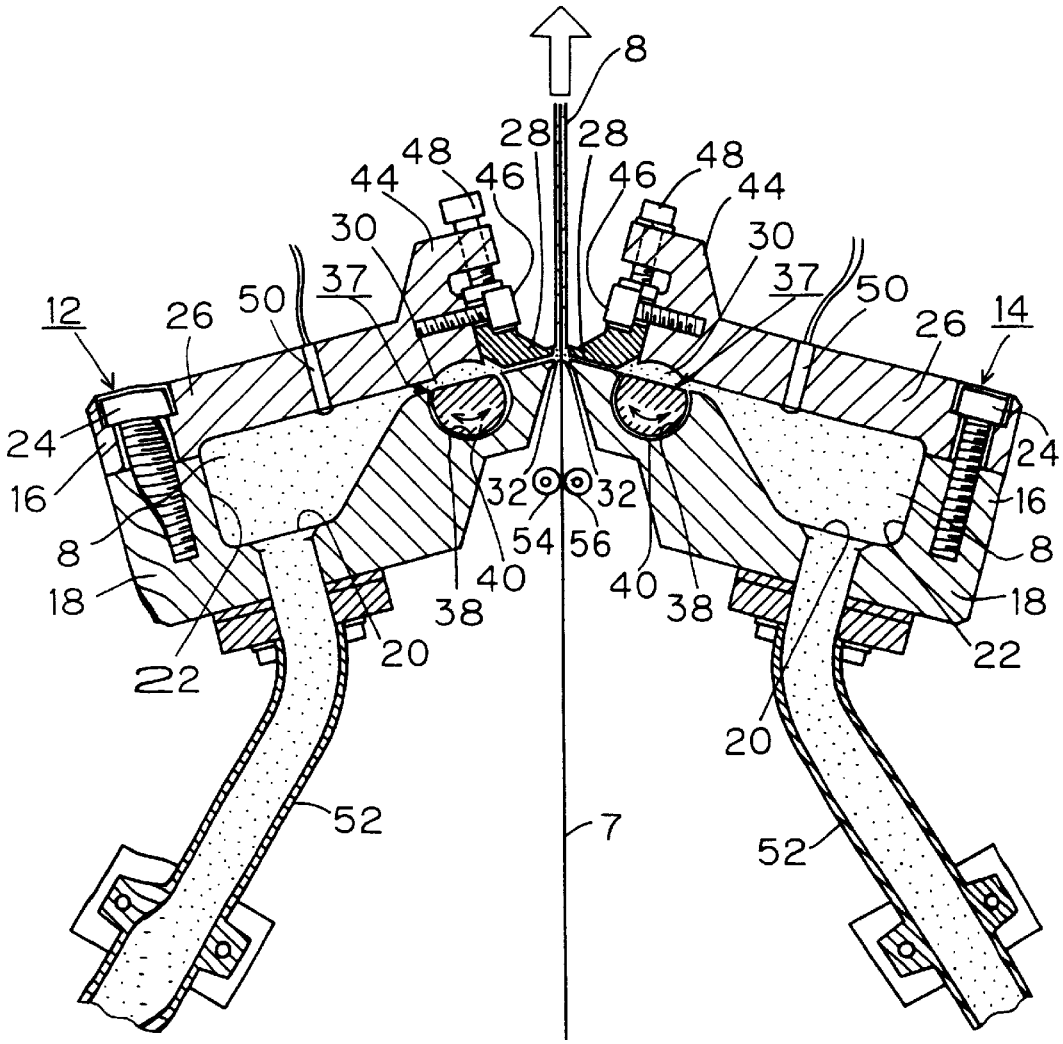
FIG. 5 is a sectional view taken from a line A—A in FIG. 3.

As described above, the valve element 40 projects from the front face of the die 12 on the left side. The valve element 40 and a servo motor 58 are connected via a universal joint 60 as shown by FIG. 3. Thereby, when the servo motor 58 is rotated, the valve element 40 is rotated. Likewise the die 14 on the right side, a servo motor 62 is connected to the valve element 40 via a universal joint 64. The servo motor 58 and the servo motor 62 are connected to the installation base 2 by a motor fixing base 66.

Figure 2:
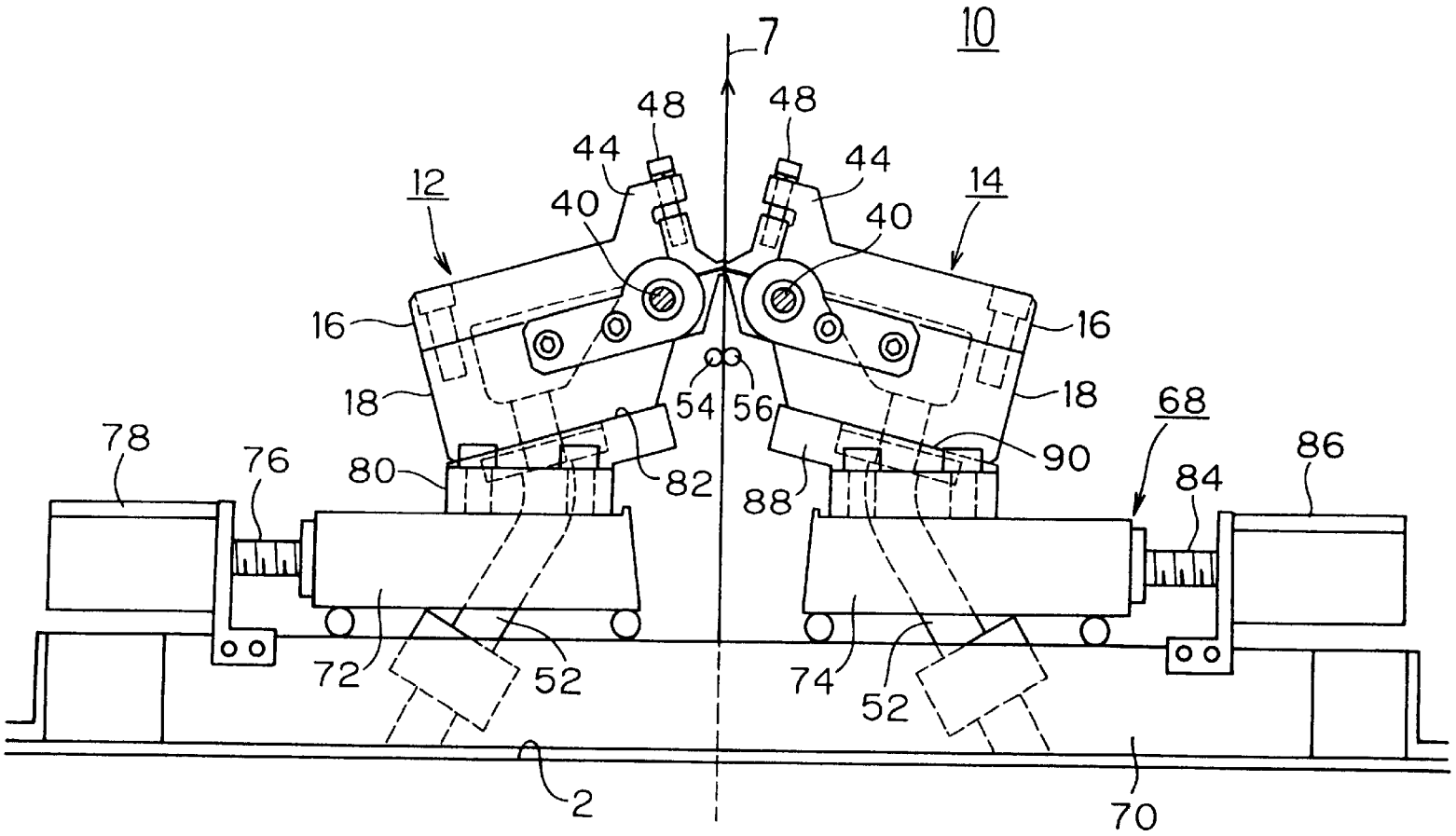
FIG. 2 is a side view of a coating apparatus.

A supporting apparatus 68 supports the pair of left and right dies 12 and 14 as shown in FIG. 2. A rail base 70 is installed on the upper face of the installation base 2. A pair of left and right trucks 72 and 74 are installed on the rail base 70. A screw rod 76 is pivotably projected from the left face of the left truck 72 on the left side and a rotational shaft of a motor 78 is connected to the screw rod 76. Thereby, by rotating the motor 78, the screw rod 76 is pivoted and the truck 72 is moved in the left and right direction on the rail base 70.

A bracket 80 is installed on the left truck 72. The upper face of the bracket 80 is provided with an inclined face 82 that is inclined by about 15° with respect to the horizontal direction. The die 12 on the left side is fixed to the inclined face 82. Thereby, the die 12 is fixed with an inclination of 15° in respect of the horizontal face.

A screw rod 84 and a motor 86 are also provided for the right truck 74 to move it in the left and right direction. Further, a bracket 88 having an inclined face 90 is installed on the upper face of the right truck 74 and the die 14 on the right side is fixed to the upper face of the inclined face 90.

Hoses 52 for carrying the coating solution 8 are attached to the left and right trucks 72 and 74 and the rail base 70.

Figure 8:
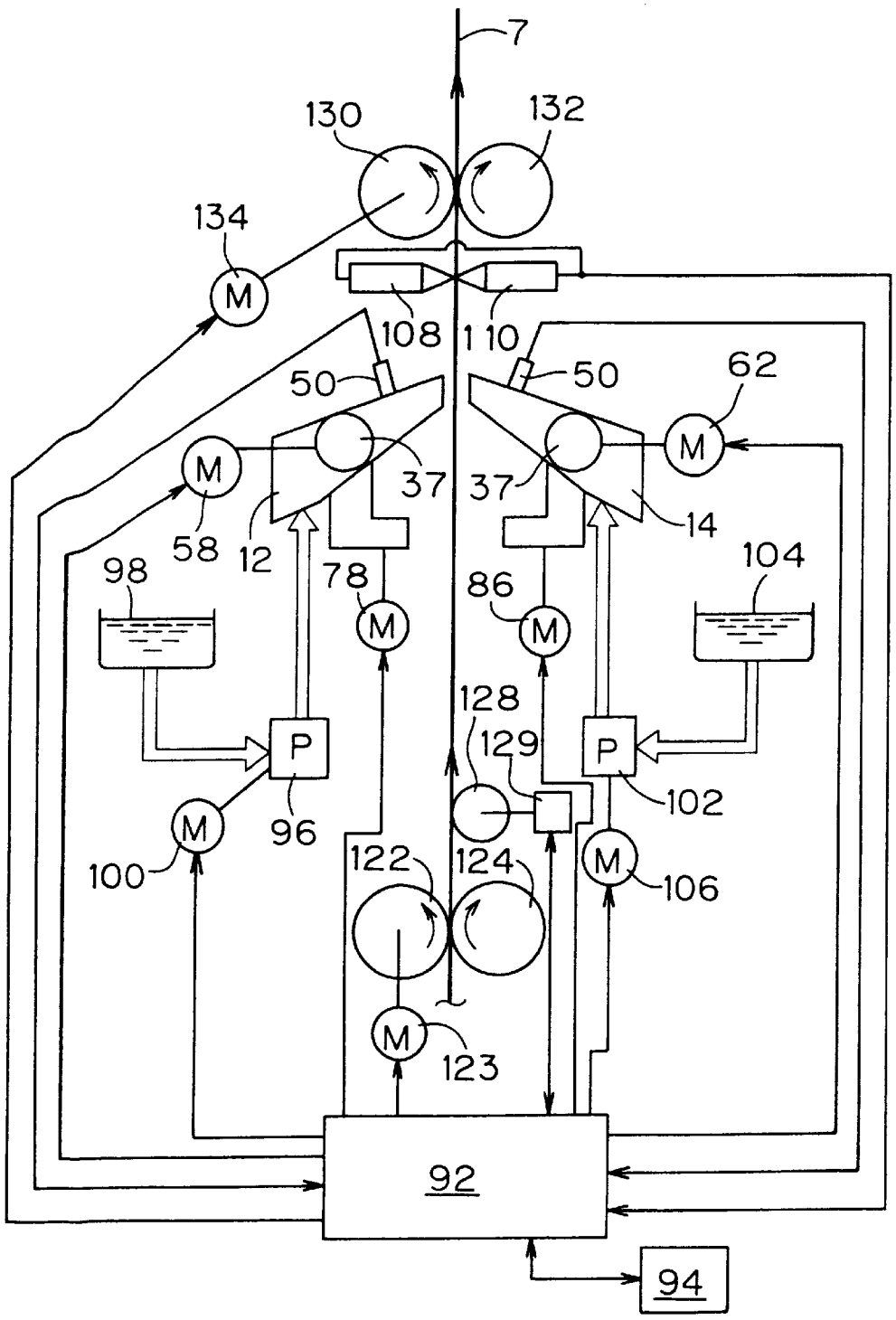
FIG. 8 is a block diagram of a control system of the coating apparatus.

FIG. 8 is a block diagram of a control system centering on a control unit 92 of the coating apparatus 10. The control unit 92 comprises an existing computer and is provided with an operating unit 94 for operating the coating apparatus 10. A constant amount pump 96 supplies the coating solution 8 at a constant amount from a coating solution tank 98 to the die 12 on the left side via the hose 52 and is operated by a pump motor 100.

A constant amount pump 102 supplies the coating solution 8 from a coating solution tank 104 at a constant amount to the die 14 on the right side via the hose 52 and is operated by a pump motor 106. Incidentally, although both of the constant amount pumps 96 and 102 are operated by the pump motors 100 and 106, an amount of the coating solution 8 fed under pressure per rotation of the constant amount pumps 96 and 102 remains always constant. Therefore, in order to increase the amount of supplying the coating solution 8, the rotational numbers of the pump motors 100 and 106 are increased. Further, when the rotational numbers N of the pump motors 100 and 106 are constant with respect to time, the supplied amount of the coating solution 8 also remains constant.

Coating thickness detecting apparatuses, 108 and 110, for respectively detecting coating thicknesses on the faces of the web 7 which comprise thickness meters or the like for carrying out measurement by a β ray or infrared ray. The thickness detecting apparatuses 108 and 110 measure the thicknesses of the coating solution 8 in a wet or a dry state.

The coated thickness detecting apparatuses 108 and 110 detect the coating thicknesses while moving along the width direction of the web 7 at a constant speed. The coating thickness detecting apparatuses 108 and 110 detect while moving average values of the thicknesses on both faces of respective sections divided in number greater than one (for example, 7) along the width direction of the web 7. Further, the measured coating thicknesses of the faces are defined by the detected average coating thicknesses of the respective faces of the plurality of sections.

Further, the control unit 92 is connected to the following motors and controls the respective rotational numbers thereof.

(1) The pump motors 100 and 106

(2) The motor 78 for moving the truck 72 on the left side and the motor 86 for moving the truck 74 on the right side (3) The servo motors 58 and 62 for rotating the rotary valves 37

(4) The in-feed motor 123

(5) The out-feed motor 134

Further, the control unit 92 inputs with signals from the pressure sensors 50 respectively installed in the pair of left and right dies 12 and 14 for measuring inner pressure of the reservoirs 22. The tension of the web 7 is also measured by the tension measuring apparatus 129.

Further, the coating thicknesses at the both faces of the web 7 are measured by signals from the coating thickness detecting apparatuses 108 and 110.

The web 7 coated by the coating apparatus 10 is sheet made of aluminum in a net-like shape and the coating solution 8 is a slurry clad material composed mainly of lithium manganese oxide. When the coating solution 8 is coated on the web, an electrode member of a lithium cell is formed. Further, other than this, as kinds of the web, cloth, plastic film, metal sheet, porous metal sheet and glass plate, which are in an elongated shape, can be coated with coating solution.

The web 7 is transferred as follows:

The web 7 led out from the lead-out roll 3 reaches the in-feed roller 122 by passing the three guide rollers 4.

The web 7 passes between the in-feed roller 122 and the nip roller 124 and reaches the tension roller 128 by passing the guide roller 126.

The web 7 is transferred to the coating apparatus 10 after passing the tension roller 128.

The web 7 with the coating operation finished, passes through the drying apparatus 5 and the coating solution is dried.

The web 7 with the coating solution dried, passes between the out-feed roller 130 and the nip roller 132 and is wound at the store roll 6.

In this embodiment, transfer speed V of the web 7 is determined by the in-feed motor 123. That is, by pinching the web 7 with the in-feed roller 122 and the nip roller 124 and driving the in-feed roller 122, the web 7 is transferred at the transfer speed V.

The out-feed motor 134 is controlled such that the out-feed roller 130 is rotated also at a rotational speed the same as that of the in-feed roller 112. Thereby, the web 7 pinched by the out-feed roller 130 and the nip roller 132 is transferred at the transfer speed V.

Further, the web 7 is elongated when high tension is applied thereon and accordingly, the web 7 needs to be transferred under low tension and under constant tension. Therefore, the tension is always monitored by the tension measuring apparatus 129 installed on the tension roller 128 and feedback control is carried out such that when the measured tension is increased, the rotational speed of the out-feed roller 130 is made slower than the rotational speed of the in-feed roller 122 and the web 7 is flexed and the tension is lowered.

A method is used to set an initial state before carrying out coating by the coating apparatus 10.

First, the pair of left and right dies 12 and 14 are installed symmetrically with each other with respect to the left and right directions centering on the transfer path of the web 7. Further, a distance between the left face of the web 7 and the right end face of the die 12 on the left side and a distance between the right face of the web 7 and the left end face of the die 14 on the right side are made equal to each other. The setting is carried out by moving the trucks 72 and 74. A fine adjustment is carried out by performing a trial coating before the coating operation.

The coating solution 8 is coated on the both faces of the web 7 by the coating apparatus 10 as follows.

(1) Operation where coating solution is coated over entire both faces of the web 7

The web 7 is arranged to move between the pair of left and right dies 12 and 14 by using the guide rollers 54 and 56 in the vertical direction from below to above.

The valve elements 40 of the rotary valves 37 are adjusted by the servo motors 58 and 62 such that the ejection paths 30 are brought into an opened state. The motors 58 and 62 are stopped to maintain the state.

A constant amount of the coating solution 8 is supplied from the constant amount pumps 96 and 102 to the reservoirs 22 of the pair of left and right dies 12 and 14. Thereby, the coating solution 8 inside the reservoirs 22 is made to flow out toward the directions of the ejection ports 32. In this case, the valve elements 40 are brought into an opened state and accordingly, flow of the coating solution is not blocked.

Figure 9A:
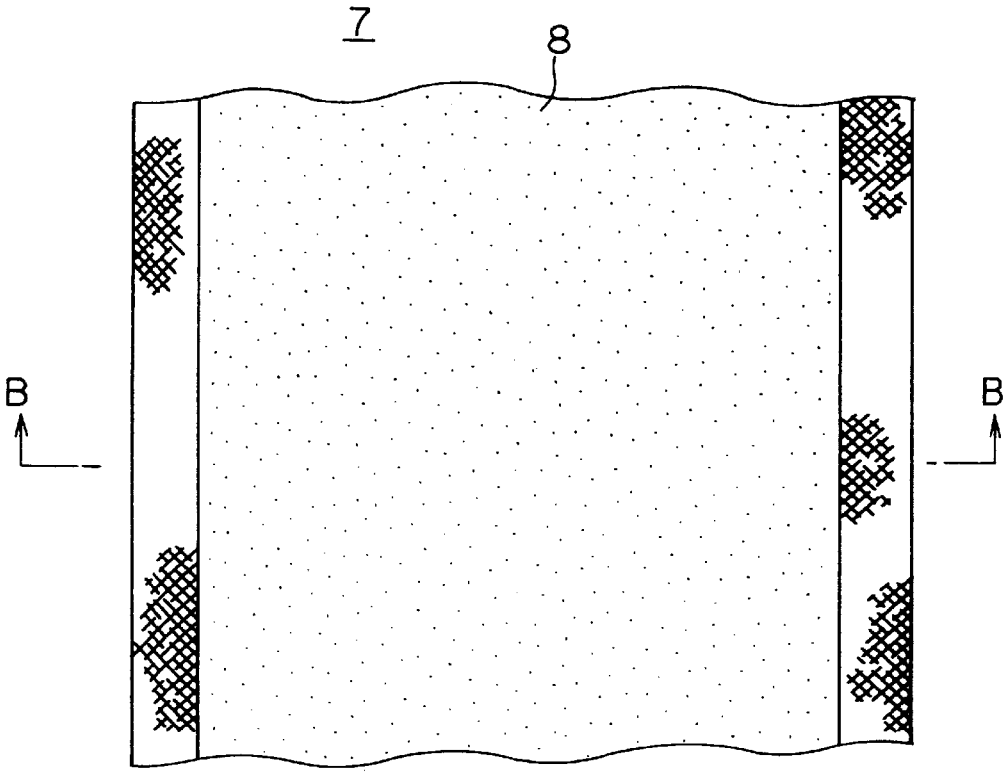
FIG. 9A is a plan view of a web that is coated by the coating apparatus of the embodiment.
Figure 9B:
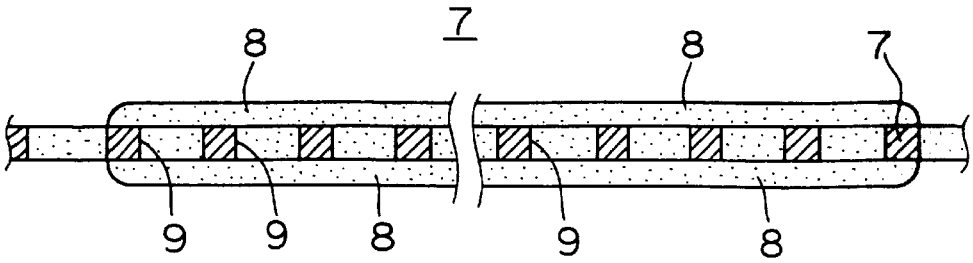
FIG. 9B is a sectional view taken from a line B—B of FIG. 9A.

When the coating operation has been carried out as described above, as shown FIG. 9A, the coating solution is coated on both faces of the web. Further, the same amount of the coating solution 8 is coated from the pair of left and right dies 12 and 14 onto both faces of the web 7 and accordingly, both faces are coated with the same coated thicknesses. In this case, as shown by FIG. 9B, even when the web 7 is metal sheet in a net-like shape, the same amount of the coating solution 8 is impregnated into through holes 9 of the net-like shape and the both faces are coated with the same coated thicknesses and at the same positions. Thereby, the electrode member of the lithium cell is constituted preferably.

Further, when there is a seam in the web 7, the seam portion is run smoothly between the pair of dies 12 and 14 by enlarging an interval between the pair of dies 12 and 14 by moving the pair of trucks 72 and 74.

(2) Operation where intermittent coating is carried out on both faces of the web.

Figure 10:
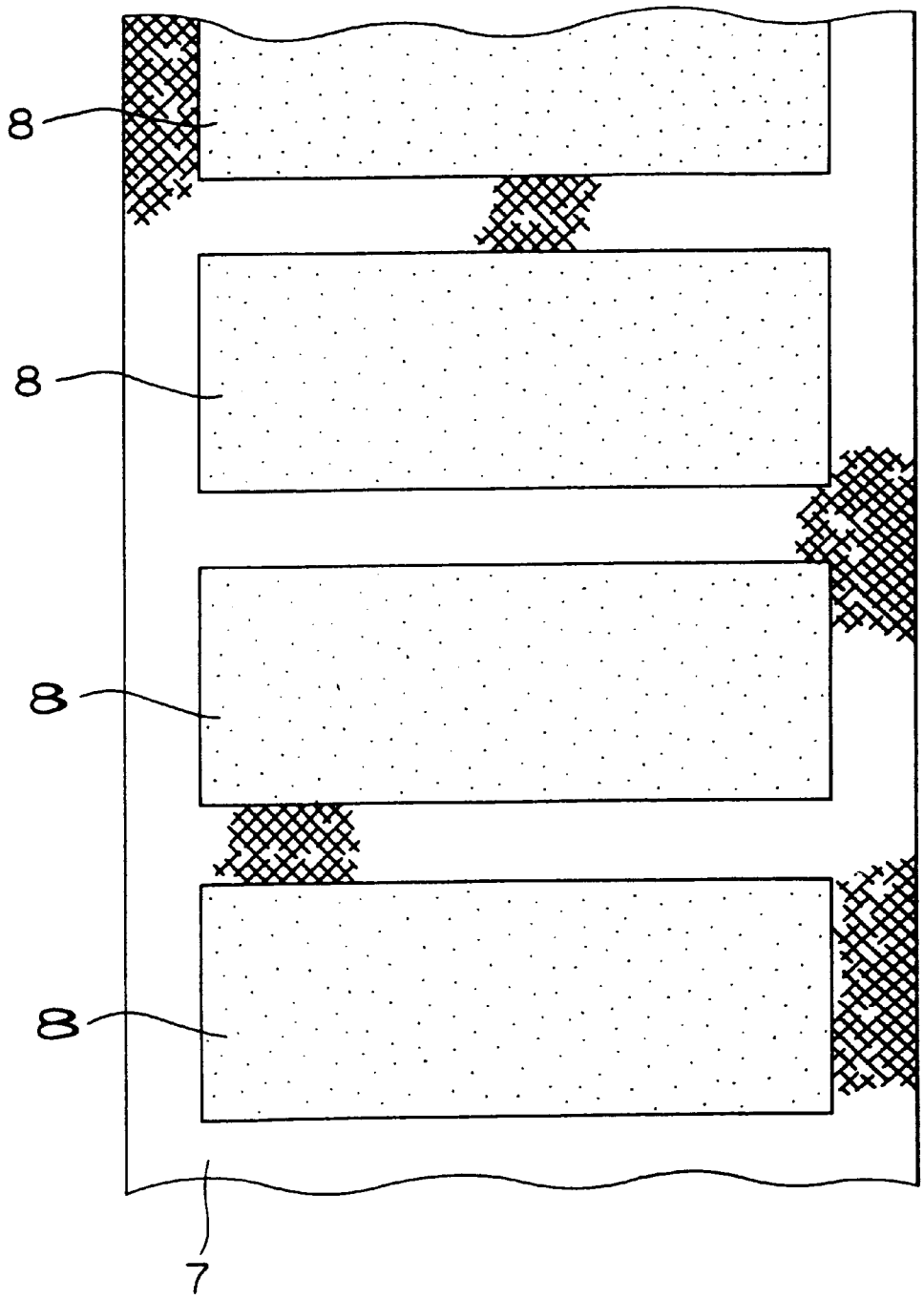
FIG. 10 is a plan view of the web on which an intermittent coating has been carried out.

When the intermittent coating is carried out on both faces of the web 7, as shown by FIG. 10, the rotary valves 37 are operated. That is, when the coated portions are formed on both faces of the web, as shown by bold lines of FIG. 7, the valve elements 40 are brought into an opened state and the coated solution is made to flow in the ejection paths 30 whereby the coating solution is ejected from the ejection ports 32. Meanwhile, when the uncoated portions which are portions where the coating solution is not coated, as shown by two-doted chain lines of FIG. 7, the valve elements 40 are brought into a closed state wherein the ejection paths 30 are blocked.

Movement of the valve elements 40 when the intermittent coating is carried out, as shown by FIG. 7, comprises rotation in the clockwise direction and rotation in the anticlockwise direction alternately repeated such that the valve elements 40 open and close the ejection paths 30. That is, the opening and closing operation is not carried out by one-directionally rotating the valve elements 40. The ejection paths 30 are opened and closed by rotating to pivot the valve elements 40 in both directions.

The reason for carrying out such opening and closing operation resides in that it is sufficient to rotate the valve elements 40 only by a rotational angle of $\ominus$. That is, when the ejection paths 30 are opened and closed by rotating the valve elements 40 by one rotation (360°), timings of opening and closing are determined by the rotational speed of the servo motors 58 and 62. However, when the valve elements 40 are rotated to pivot above way, the opening and closing operation can be carried out by rotating the servo motors 58 and 62 only by the rotational angle $\theta$ and accordingly, the timings of opening and closing can be made swift. As an effect thereof, when the uncoated portions and the coated portions are formed, the coating operation is carried out by conforming lengths of the coated portion or the uncoated portion along the transfer direction to object lengths without depending on the rotational speed of the servo motors 58 and 62. In short, the length of the uncoated portion or the coated portion can be made very short since the opening and closing operation of the valve elements 40 can be carried out swiftly.

(3) Operation where different patterns of intermittent coating is carried out on both faces of web Although according to the intermittent coating of the web in the above-described operation (2) the coating of the same pattern is carried out on both faces, different patterns of intermittent coating can be carried out on the both faces of the web 7.

When timings of rotation of the servo motor 58 on the left side and the servo motor 62 on the right side are varied, timings of opening and closing the valve element 40 on the left side and the valve element 40 on the right side differ from each other. Accordingly, timings of ejecting the coating solution onto both faces of the web 7 differ from each other and the coated portions and the uncoated portions can alternately be formed at portions of both faces of the web 7 different from each other.

Three kinds of control methods for the coating apparatus 10 may be effected.

(First control method)

The coating apparatus 10 of the above embodiment is operated by a method of coating the web 7 by ejecting the same amount of the coating solution 8 under pressure from the dies 12 and 14 and accordingly, the coated thicknesses are determined by the ejection amounts of the constant amount pumps 96 and 102. That is, the ejection amount per unit time of the constant amount pump 96 or 102 is determined by a product of a coated width by a coated thickness of the web 7, that is, a volume of a coated amount.

The coated thickness in the above case is a coated thickness in a wet state. Further, the ejection amount of the coating solution 8 per unit time is determined by the rotational numbers of the constant amount pumps 96 and 102. It is important that it is necessary to eject the same amount of the coating solution 8 from the dies 12 and 14 in order to equalize the coated thicknesses at the both faces of the web 7 and, for that purpose, the same ejection amounts are ejected by similarly operating the constant amount pump 96 and the constant amount pump 102.

Accordingly, the rotational number (rpm) of the constant amount pump 96 or 102 is determined by Equation (1).

$$N=(D\times W\times V)/(K1\times Q) \quad (1)$$

wherein notation D designates a coated thickness (mm) in a wet state, notation W designates a coated width (mm), notation V designates a transfer speed (m/minute), notation Q designates an ejection amount (cc/REV) per rotation of the constant amount pump 96 or 102 and notation K1 designates a constant.

Q may be regarded as a constant when the type of pump of the constant amount pump 96 or 102 is determined and accordingly, Equation (1) is as follows.

$$N=(D\times W\times V)/(K2) \quad (2)$$

wherein K2=K1×Q.

Accordingly, when numerical values of the coated thickness D in a wet state and the coated width W are inputted to the control unit 92 via the operating unit 94 and the transfer speed V of the web 7 is inputted to the control unit 92 via an AD converter, the control unit 92 controls the motors 100 and 106 for rotating the constant amount pumps 96 and 102 by the pump rotational number N calculated by Equation (2).

In this way, the rotational number N of the constant amount pumps 96 and 102 automatically follows a change in the transfer speed V and even when the transfer speed V is varied, the coating solution 8 can be coated always with the same coated thickness and the same coated width.

(Second control method)

The change of the coated thickness or the coated width is not normally carried out in the coating operation and therefore, the coated thickness D and the coated width W in Equation (2) can be regarded as constants. Accordingly, Equation (2) can be expressed as follows.

$$N=K3\times V \quad (3)$$

wherein $$K3=D\times W/K2 \quad (3)'.$$

The above constant K3 includes the coated thickness D. The coated thickness D may be varied and accordingly, an average value Dp with respect to the entire coated widths of the respective faces need to be measured by the coated thickness detecting apparatuses 108 and 110 and the variations of Dp need to be reflected to K3. Accordingly, when attention is paid to K3 from a view point different from Equation (3'), that is, when attention is paid only to the coated thickness, the following equation is given.

$$K3=Ds/Dp\times K0 \quad (4)$$

wherein notation Ds designates a set coated thickness and notation K0 designates a constant.

By substituting the calculation by Equation (4) for Equation (3), the rotational number N of the constant amount pump 96 or 102, in correspondence with the set coated thickness, is represented by Equation (5).

$$N=(Ds\times V\times K0)/Dp. \quad (5)$$

Thereby, the rotational number N of the constant amount pump 96 or 102 not only automatically follows a variation in the transfer speed of V but can correspond to a variation in the coated thickness and accordingly, the coating solution 8 can be coated always with the same coated thickness and the same coated width.

The coated thickness of the web 7 is controlled by the two control methods described above whereby the uniform coating with the same thickness can be carried out on the both faces of the web 7.

(Third control method)

Figure 16:
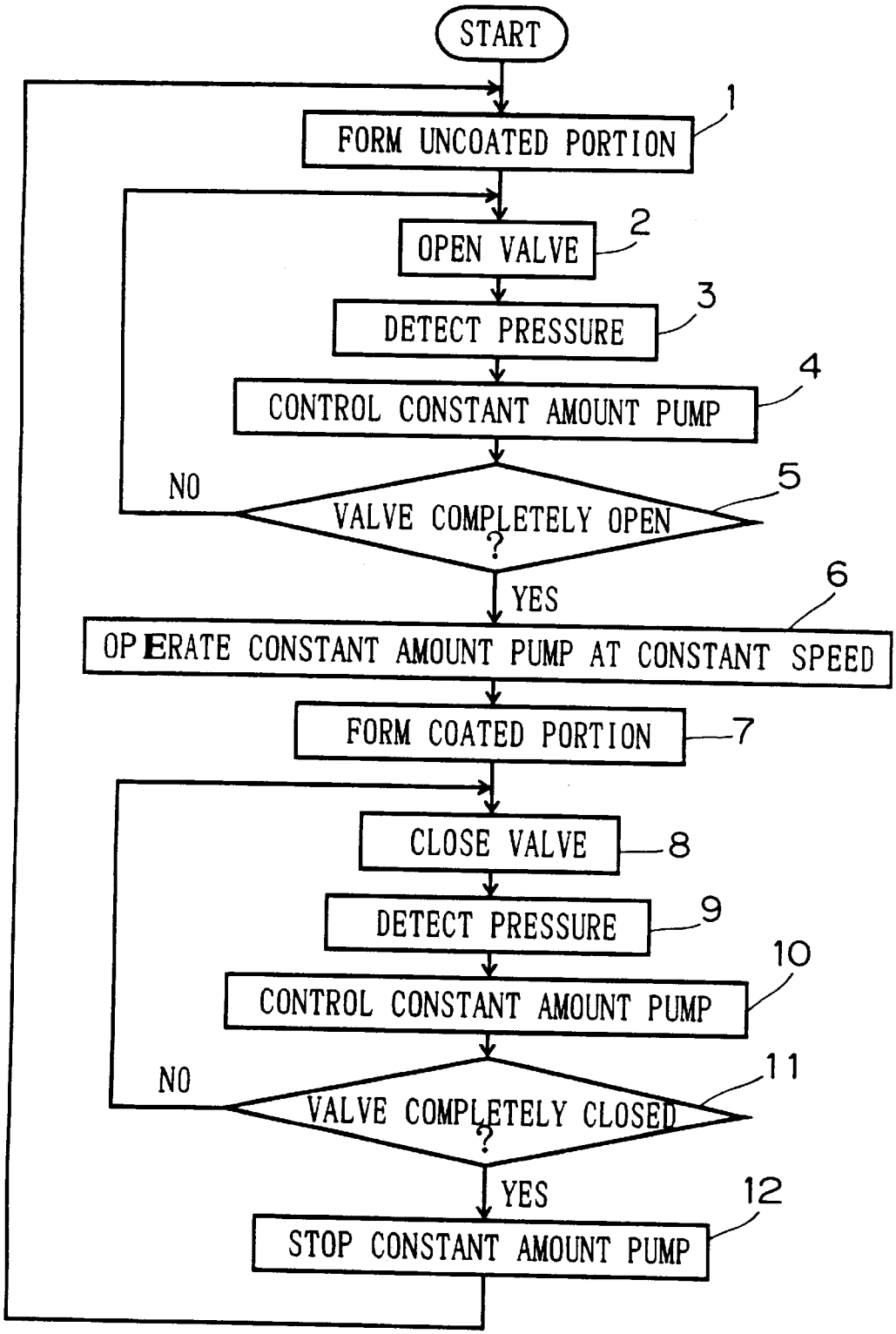
FIG. 16 is a flowchart of a control method.

Although an explanation has been given of the operation where the coating solution is coated continuously on both faces of the web 7 according to the first control method and the second control method, a third control method is used in the operation of carrying out the intermittent coating. That is, operation wherein the uncoated portions and the coated portions are formed which is shown in a flowchart of FIG. 16.

In step 1, an uncoated portion is formed by transferring a predetermined length of the web 7 without coating the coating solution on the web 7.

In step 2, the valve elements 40 are rotated by a predetermined angle to produce an opened state. Then, the internal pressure of the reservoirs 22 starts reducing.

In step 3, the pressure sensors 50 detect the internal pressure of the reservoirs 22 which starts reducing.

In step 4, an amount of supplying the coating solution 8 is increased by increasing the rotational number of the constant amount pumps 96 and 102 such that the internal pressure of the reservoirs 22 is maintained constant.

In step 5, when the valve elements 40 are brought into a completely opened state, the operation proceeds to step 6 and otherwise, the operation from step 2 to step 4 is continued.

In step 7, the rotational number of the constant amount pumps 96 and 102 is maintained constant such that internal pressure of the reservoirs 22 is maintained constant.

In step 7, the coated portion is formed by transferring a predetermined length of the web 7 while coating the coating solution. In this case, the above-described two control methods are used.

In step 8, when the predetermined length of the web 7 is transferred, the valve elements 40 are rotated by a predetermined angle to shift from the opened state to a closed state in order to form successively the uncoated portion. Then, the internal pressure of the reservoirs 22 starts increasing.

In step 9, the pressure sensors 50 detect the internal pressure of the reservoirs 22 which starts increasing.

In step 10, the amount of supplying the coating solution 8 is reduced by reducing the rotational number of the constant amount pumps 96 and 102 to thereby maintain the internal pressure of the reservoirs 22 constant.

In step 11, when the valve elements 40 are brought into a completely closed state, the operation proceeds to step 12 otherwise, the operation from step 8 to step 11 is continued.

In step 12, rotation of the constant amount pumps 96 and 102 is stopped. Further, the operation returns to step 1.

Figure 17:
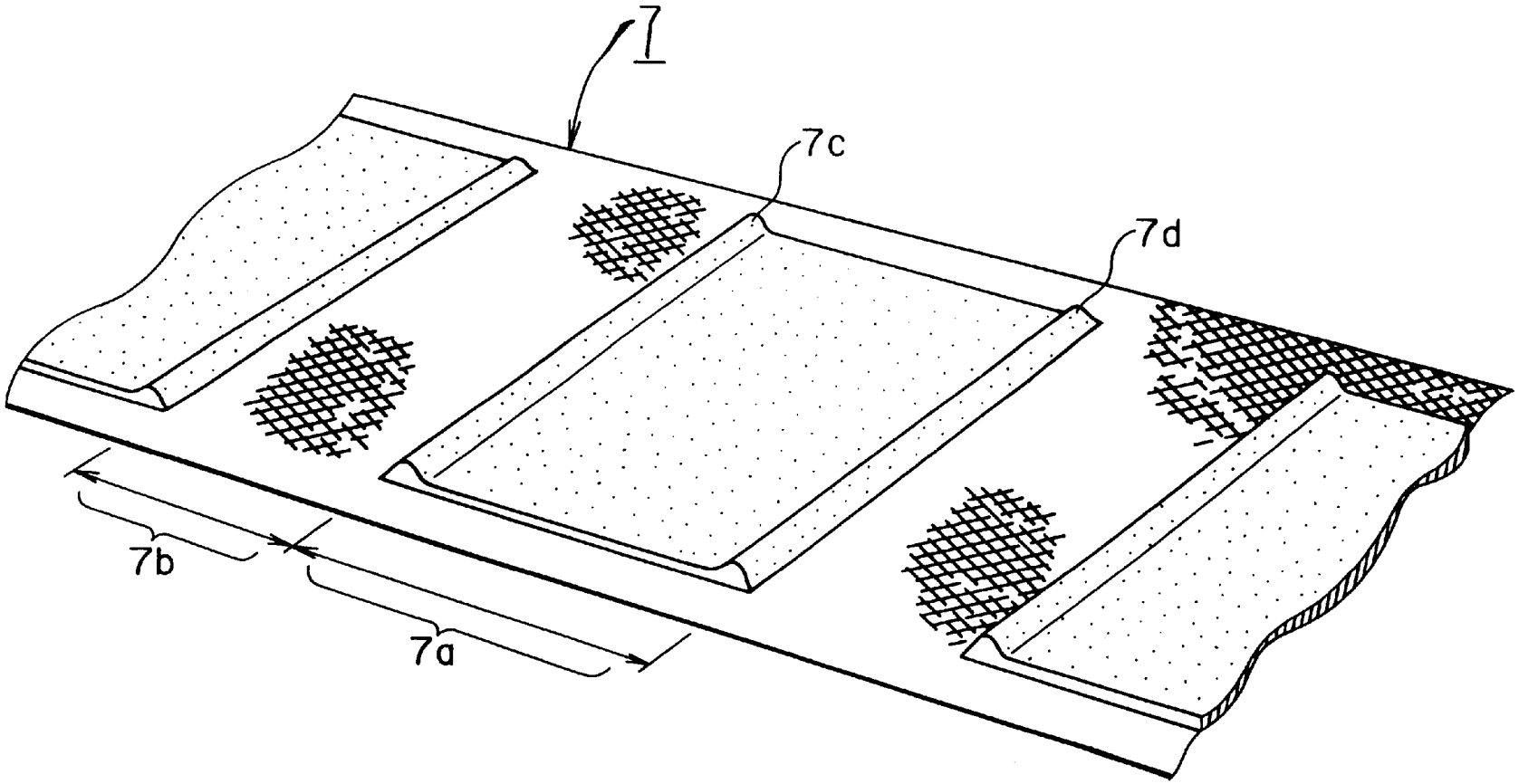
FIG. 17 is a perspective view of a web in which conventional intermittent coating has been carried out.

Thereby, the coated portion is formed while always maintaining the internal pressure of the reservoirs 22 constant and accordingly, the phenomenon where an amount of the coating solution larger than that of other portions is coated at a position of the coated portion where the coating is started and a position thereof where the coating is finished, and those portions of the coated portion are swollen, as shown by FIG. 17, does not occur.

Further, the interval between the pair of dies 12 and 14 may be adjusted by the motors 76 and 86 to prevent the swelling phenomenon. Specifically, the interval between the pair of dies 12 and 14 is increased more than those in the normal coating operation at the position where the coating is started and the position where the coating is finished.

[Second Embodiment]

A second embodiment of the coating apparatus 20 is described below reference to FIG. 12 through FIG. 14.

The coating apparatus 10, according to the second embodiment, can carry out stripe coating and a difference of the coating apparatus 10 according to the second embodiment from the coating apparatus 10 according to the first embodiment resides in that stripe coating members 150 for stripe coating are installed between the upper members 16 and the lower members 18. Coated sections and uncoated sections are alternately formed in the width direction of the web.

Figure 11:
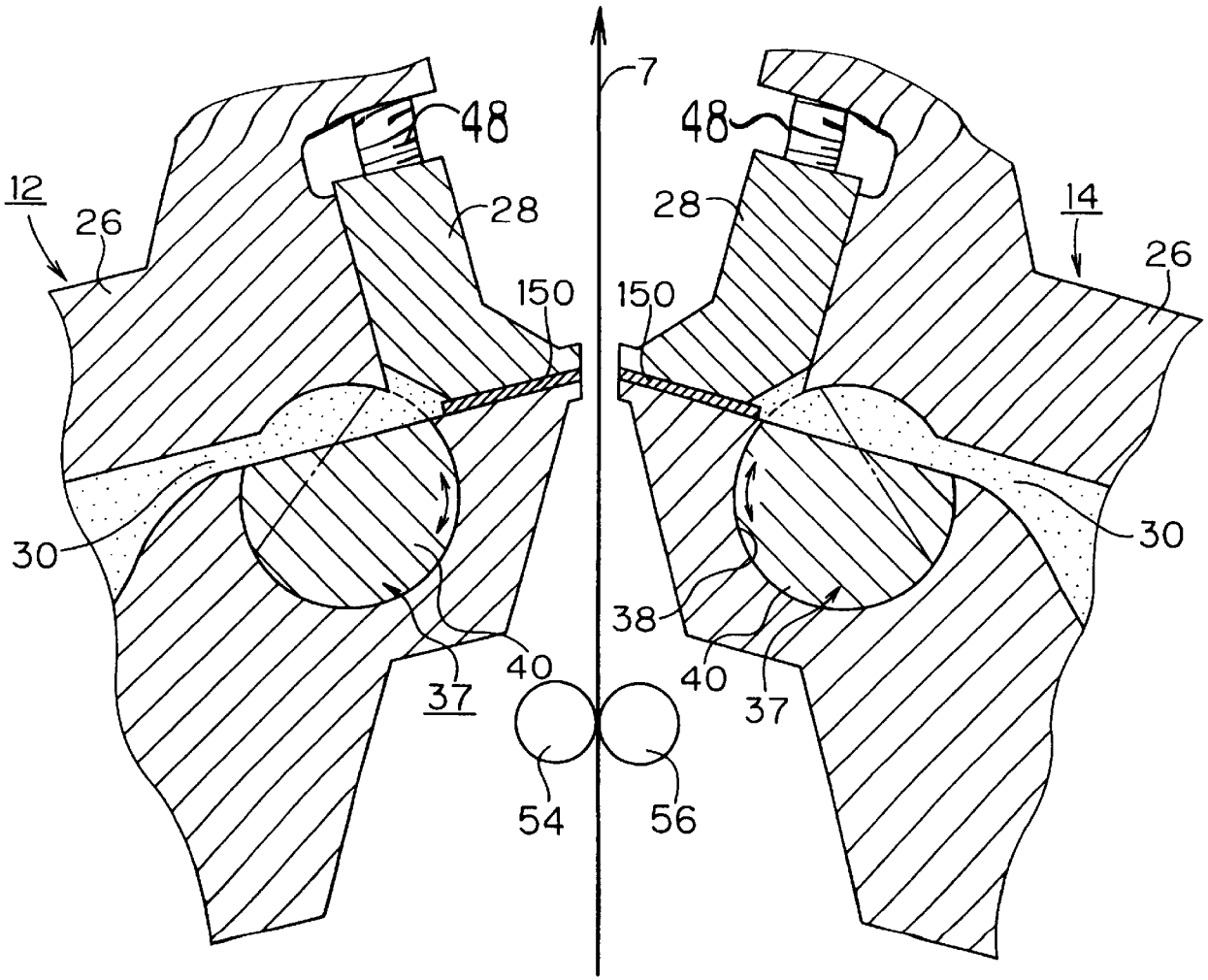
FIG. 11 is cross-sectional view magnifying portions of the ejection ports of the pair of left and right dies in which stripe coating members are arranged.
Figure 12:
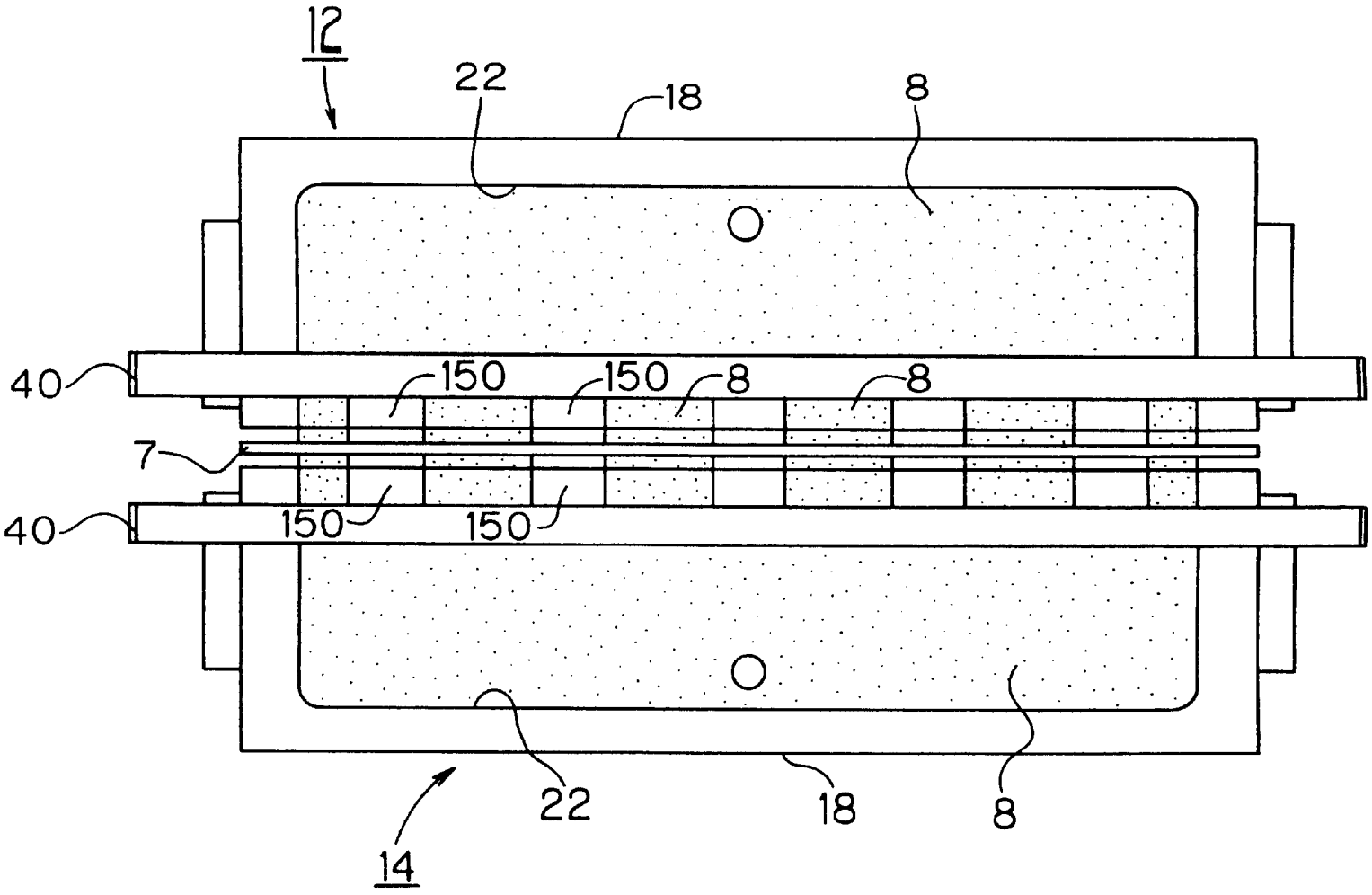
FIG. 12 is a plan view of a state where the stripe coating member is similarly arranged to the lower member.

The stripe coating member 106 is formed in a plate-like shape and is inserted into the ejection path 30 provided between the front end member 28 and the lower member 18 as shown by FIG. 11 and FIG. 12. Further, when the coated portion is formed by the stripe coating, the stripe coating member 150 is not arranged and the stripe coating member 150 is inserted thereinto only when the uncoated portion is formed. That is, a block portion is formed at a portion of the ejection path 30 where the stripe coating member 150 is installed and an ejection space is formed at a position thereof where the stripe coating member 150 is not disposed.

Intermittent coating herein is forming-alternately the coated sections and the uncoated sections along the direction of transferring the web.

Figure 13:
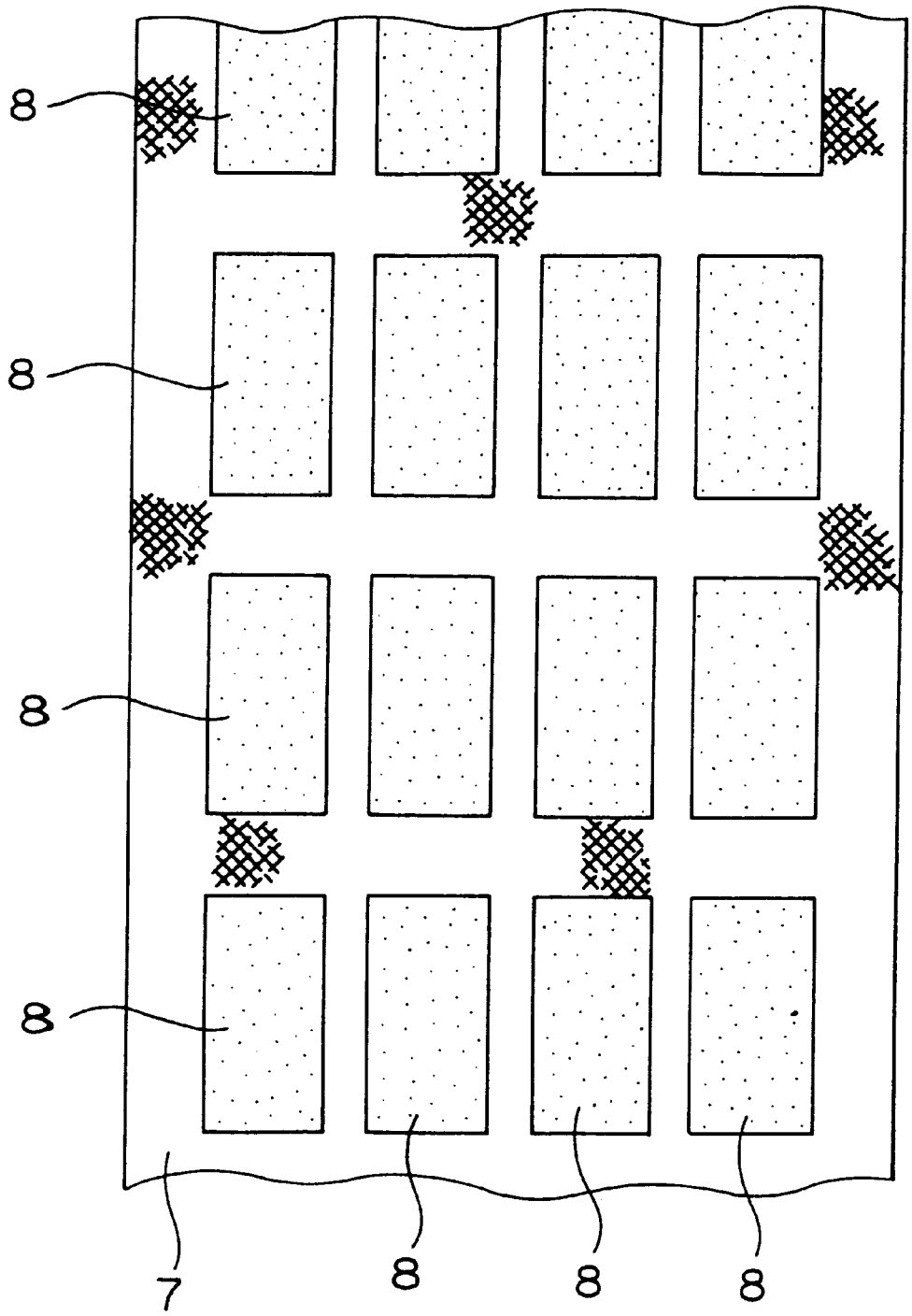
FIG. 13 is a plan view of the web in which patch coating has been carried out.

When the above-described stripe coating members 150 are installed to the coating apparatus 10, the stripe coating and the intermittent coating can simultaneously be carried out and accordingly, so-called patch coating where the coated sections are formed in a shape of a lattice is realized as shown by FIG. 13.

In order to carry out the patch coating, the stripe coating members 150 are installed while opening and closing the rotary valves 37.

Figure 14:
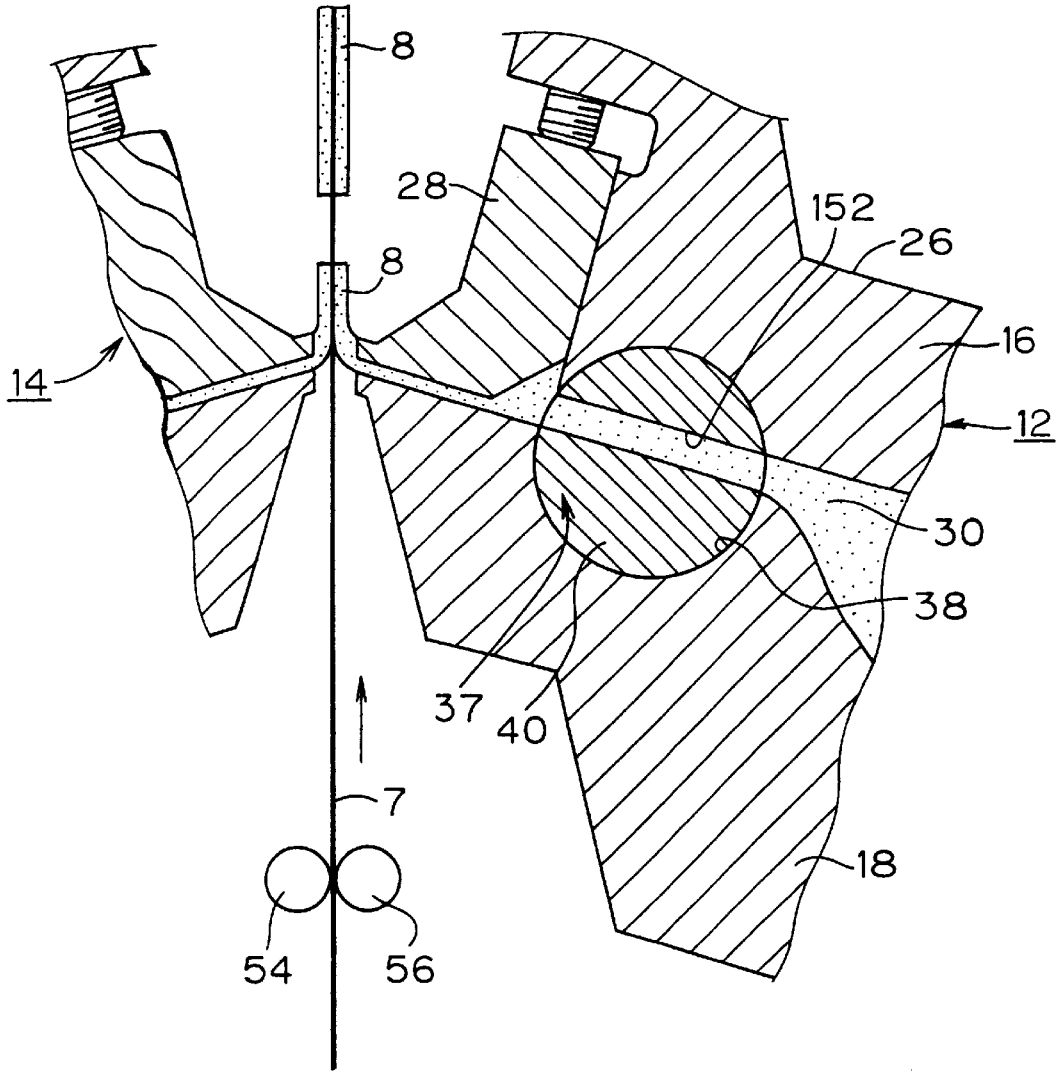
FIG. 14 is cross-sectional view magnifying portions of the ejection ports of the pair of left and right dies showing a modified example of valves.
Figure 15:
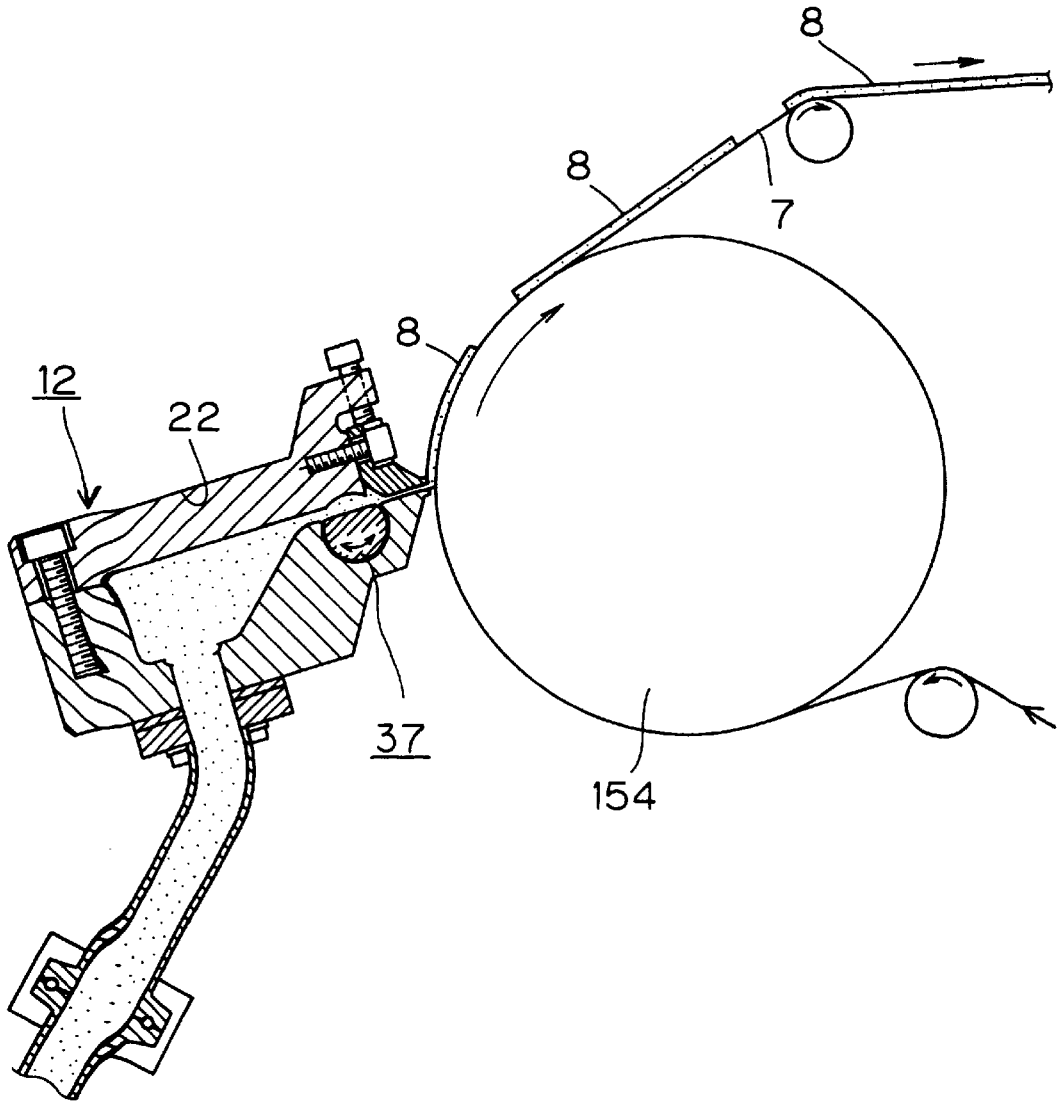
FIG. 15 is cross-sectional view of of an apparatus wherein one face of the web is coated by using one die.

As a modified example of the valve element 40, as shown by FIG. 14, a through port 152 may be installed to the central portion of the valve element 40 having a section in a circular shape and the coating solution may flow through the through port 152.

Although according to the above-described embodiments, the pair of dies 12 and 14 are installed on both sides of the web 7 to coat both faces of the web, the die 12 can coat only one face of the web 7.

As shown by FIG. 17, the web 7 may be transferred by a back-up roll 154 and the die 12 is arranged on the left side of the back-up roll 154.

Further, the intermittent coating can be carried out on one face of the web 7 transferred by the back-up roll 154 by intermittently ejecting the coating solution from the die 12.

When the inclined faces 82 and 92 of the left and right brackets 80 and 88 are made to freely be inclined, the angle of inclination of the die 12 can freely be adjusted.

For example, although according to the above-described embodiments, the right end portion of the lip structure, that is, the right end face 34 of the lower member 18 and the right end face 36 of the front end member 28 are made parallel to the transferred web 7, when the coating solution flows easily since the viscosity is small, the coating solution may be prevented from being spilt by increasing the inclinations of the inclined faces 82 and 90 and projecting the right end face 34 of the lower member 18 from the right end face 36 of the front end member 28.

According to a coating apparatus of a duplex coating type of the present invention, intermittent coating can be carried out on both faces of a web by operating rotary valves by driving means.

Further, intermittent coating of different patterns can be carried out respectively on both faces of a web by respectively providing driving means to left and right rotary valves.

Further, stripe coating can be carried out by alternately providing ejection spaces and block spaces in ejection paths and patch coating can be carried out by operating the rotary valves.

What is claimed is:

1. A coating apparatus for coating opposing sides of a web, traveling in a traveling direction along a transfer paths with a coating solution, comprising:

dies installed on opposing sides of said transfer path;

said dies each including a reservoir for storing the coating solution inside respective ones of said dies;

said dies each having an ejection port with an elongated width along a width direction of the web for ejecting the coating solution;

ejection paths for the coating solution communicating substantially the elongated width of the ejection ports with respective ones of said reservoirs;

coating solution supplying means for supplying a controlled amount of the coating solution to said reservoirs to effect ejection of the coating solution onto opposing sides of the web by ejecting the coating solution respectively from said ejection ports onto the web;

each of said ejection paths having a rotary valve with a rotatable valve element of a substantially cylindrical shape extending parallel to and along a width of the elongated width of the ejection ports which opens said ejection path when positioned within a first angular range and closes said ejection path when positioned within a second angular range; and driving means for pivoting said rotatable valve elements of the rotary valves between said first angular range and said second angular range to provide intermittent flow of said coating solution to apply an intermittent coating to said web.

2. The coating apparatus according to claim 1, wherein each of said rotatable valve elements is formed with a flow path portion defined by circumferential notch portion extending in an axial direction of said rotatable valve elements along the elongated width of said ejection ports.

3. The coating apparatus according to claim 1, wherein each of said rotatable valve elements is substantially cylindrical except for said circumferential notch portion which is a substantially flat chordal surface extending axially the length of the elongated width of said ejection ports for allowing said coating solution to flow thereby and through said ejection paths when said rotatable valve elements are positioned within said first angular range.

4. The coating apparatus according to claim 3, wherein said substantially flat chordal surfaces are in alignment with said ejection paths when said rotary valves are open.

5. A coating apparatus for coating opposing sides of a web, traveling in a traveling direction along a transfer path, with a coating solution, comprising:

dies installed on opposing sides of said transfer path, said dies each including a reservoir for storing the coating solution inside respective ones of said dies;

said dies each having an ejection port with an elongated width along a width direction of the web for ejecting the coating solution;

ejection paths for the coating solution communicating substantially the elongated width of the ejection ports with respective ones of said reservoirs;

coating solution supplying means for supplying a controlled amount of the coating solution to said reservoirs to effect ejection of the coating solution onto opposing sides of the web by ejecting the coating solution respectively from said ejection ports onto the web;

each of said ejection paths having a rotary valve with a rotatable valve element of a substantially cylindrical shape extending parallel to and along a width of the elongated width of the ejection ports which opens said ejection path when positioned within a first angular range and closes said ejection path when positioned within a second angular range; and driving means for opening and closing said injection paths by repeatedly rotating said rotatable valve elements in a forward direction and then a reverse direction to pivot said rotatable valve elements between said first angular range and said second angular range to provide intermittent flow of said coating solution to apply an intermittent coating to said web.

6. The coating apparatus according to claim 5, wherein each of said rotatable valve elements is substantially cylindrical except for said circumferential notch portion which is a substantially flat chordal surface extending axially the length of the elongated width of said ejection ports for allowing said coating solution to flow thereby and through said ejection paths when said rotatable valve elements are positioned within said first angular range.

7. The coating apparatus according to claim 6, wherein said substantially flat chordal surfaces are in alignment with said ejection paths when said rotary valves are open.

8. A coating apparatus for coating opposing sides of a web, traveling in a traveling direction along a transfer path, with a coating solution, comprising:

dies installed on opposing sides of said transfer path;

said dies each including a reservoir for storing the coating solution inside respective ones of said dies;

said dies each having an ejection port with an elongated width along a width direction of the web for ejecting the coating solution;

ejection paths for the coating solution communicating substantially the elongated width of the ejection ports with respective ones of said reservoirs;

coating solution supplying means for supplying a controlled amount of the coating solution to said reservoirs to effect ejection of the coating solution onto opposing sides of the web by ejecting the coating solution respectively from said ejection ports onto the web;

each of said ejection paths having a rotary valve with a rotatable valve element of a substantially cylindrical shape extending parallel to and along a width of the elongated width of the ejection ports which opens said ejection path when positioned within a first angular range and closes said ejection path when positioned within a second annular range;

driving means for pivoting said rotatable valve elements of the rotary valves between said first angular range and said second angular range to provide intermittent flow of said coating solution to apply an intermittent coating to said web; and a die moving means for varying a spacing between said ejection ports of said dies by moving at least one of said dies in a direction orthogonal to the transfer path.

9. A coating apparatus for coating opposing sides of a web, traveling in a traveling direction along a transfer path, with a coating solution, comprising:

dies installed on opposing sides of said transfer path;

said dies each including a reservoir for storing the coating solution inside respective ones of said dies;

said dies each having an ejection port with an elongated width along a width direction of the web for ejecting the coating solution;

ejection paths for the coating solution communicating substantially the elongated width of the ejection ports with respective ones of said reservoirs;

coating solution supplying means for supplying a controlled amount of the coating solution to said reservoirs to effect ejection of the coating solution onto opposing sides of the web by ejecting the coating solution respectively from said ejection ports onto the web;

each of said ejection paths having a rotary valve with a rotatable valve element of a substantially cylindrical shape extending parallel to and along a width of the elongated width of the ejection ports which opens said ejection path when positioned within a first angular range and closes said ejection path when positioned within a second angular range;

driving means for pivoting said rotatable valve elements of the rotary valves between said first angular range and said second angular range to provide intermittent flow of said coating solution to apply an intermittent coating to said web;

said driving means for pivoting said rotatable valve elements including drives for individually controlling said rotatable valve elements; and a controller for controlling the drive means to individually varying timings for opening and closing said rotatable valve elements to open and close the injection paths to effect differing intermittent coatings on said opposing sides of the web.

10. A coating apparatus for coating opposing sides of a web, traveling in a traveling direction along a transfer path, with a coating solution, comprising:

dies installed on opposing sides of said transfer path;

said dies each including a reservoir for storing the coating solution inside respective ones of said dies;

said dies each having an ejection port with an elongated width along a width direction of the web for ejecting the coating solution;

ejection paths for the coating solution communicating substantially the elongated width of the ejection ports with respective ones of said reservoirs;

coating solution supplying means for supplying a controlled amount of the coating solution to said reservoirs to effect ejection of the coating solution onto opposing sides of the web by ejecting the coating solution respectively from said ejection ports onto the web;

each of said ejection paths having a rotary valve with a rotatable valve element of a substantially cylindrical shape extending parallel to and along a width of the elongated width of the ejection ports which opens said ejection path when positioned within a first angular range and closes said ejection path when positioned within a second angular range;

driving means for pivoting said rotatable valve elements of the rotary valves between said first angular range and said second angular range to provide intermittent flow of said coating solution to apply an intermittent coating to said web; and at least one of said ejection ports having at least one blocking member disposed at a position along said elongated width of said at least one ejection port to block ejection of the coating solution to thereby produce a striped coating along the width direction of the web.

11. A coating apparatus for coating opposing sides of a web, traveling in a traveling direction along a transfer path, with a coating solution comprising:

dies installed on opposing sides of said transfer path;

said dies each including a reservoir for storing the coating solution inside respective ones of said dies;

said dies each having an ejection port with an elongated width along a width direction of the web for ejecting the coating solution;

ejection paths for the coating solution communicating substantially the elongated width of the ejection ports with respective ones of said reservoirs;

coating solution supplying means for supplying a controlled amount of the coating solution to said reservoirs to effect ejection of the coating solution onto opposing sides of the web by ejecting the coating solution respectively from said ejection ports onto the web;

each of said ejection paths having a rotary valve with a rotatable valve element of a substantially cylindrical shape extending parallel to and along a width of the elongated width of the ejection ports which opens said ejection path when positioned within a first angular range and closes said ejection path when positioned within a second angular range;

driving means for pivoting said rotatable valve elements of the rotary valves between said first angular range and said second angular range to provide intermittent flow of said coating solution to apply an intermittent coating to said web;

transfer speed detecting means for detecting a transfer speed V of the web;

said coating liquid supply means including constant amount pumps for supplying amounts of the coating solution at a constant ejection amount per rotation respectively to said reservoirs; and first control means for controlling a rotational number N of the constant amount pumps in accordance with the transfer speed V detected by the transfer speed detecting such that $$N=(D\times W\times V)/(K1\times Q),$$

wherein notation D designates a set coated thickness in a wet state, notation W designates a set coated width of the web, notation Q designates the ejection amount per rotation of the constant amount pump and notation K1 designates a constant.

12. A coating apparatus for coating opposing sides of a web, traveling in a traveling direction along a transfer path with a coating solution, comprising:

dies installed on opposing sides of said transfer path;

said dies each including a reservoir for storing the coating solution inside respective ones of said dies;

said dies each having an ejection port with an elongated width along a width direction of the web for ejecting the coating solution;

ejection paths for the coating solution communication substantially the elongated width of the ejection ports with respective ones of said reservoirs;

coating solution supplying means for supplying a controlled amount of the coating solution to said reservoirs to effect ejection of the coating solution onto opposing sides of the web by ejecting the coating solution respectively from said ejection ports onto the web;

each of said ejection paths having a rotary valve with a rotatable valve element of a substantially cylindrical shape extending parallel to and along a width of the elongated width of the ejection ports which opens said ejection path when positioned within a first angular range and closes said ejection path when positioned within a second angular range;

driving means for pivoting said rotatable valve elements of the rotary valves between said first angular range and said second angular range to provide intermittent flow of said coating solution to apply an intermittent coating to said web;

transfer speed detecting means for detecting a transfer speed V of the web;

said coating liquid supply means including constant amount pumps for supplying amounts of the coating solution at a constant ejection amount per rotation respectively to said reservoirs;

coated thickness detecting means for detecting an averaged coated thickness Dp with respect to the width direction of the web; and control means for controlling a rotational number N of the constant amount pumps in accordance with the transfer speed V, detected by the transfer speed detecting means, and the averaged coated thickness Dp from the coated thickness detecting means such that $$N=(Ds\times V\times K0)/Dp,$$

wherein Ds designates the set coated thickness in a wet state and notation K0 designates a constant.

13. A coating apparatus for coating opposing sides of a web, traveling in a traveling direction along a transfer path with a coating solution, comprising:

dies installed on opposing sides of said transfer path;

said dies each including a reservoir for storing the coating solution inside respective ones of said dies;

said dies each having an ejection port with an elongated width along a width direction of the web for ejecting the coating solution;

ejection paths for the coating solution communicating substantially the elongated width of the ejection ports with respective ones of said reservoirs;

coating solution supplying means for supplying a controlled amount of the coating solution to said reservoirs to effect ejection of the coating solution onto opposing sides of the web by ejecting the coating solution respectively from said ejection ports onto the web;

each of said ejection paths having a rotary valve with a rotatable valve element of a substantially cylindrical shape extending parallel to and along a width of the elongated width of the ejection ports which opens said ejection path when positioned within a first angular range and closes said ejection path when positioned within a second angular range;

driving means for pivoting said rotatable valve elements of the rotary valves between said first angular range and said second angular range to provide intermittent flow of said coating solution to apply an intermittent coating to said web;

pressure measuring means for measuring an internal pressure of said reservoirs;

said coating liquid supply means including constant amount pumps for supplying amounts of the coating solution at a constant ejection amount per rotation respectively to said reservoirs; and control means for reducing a rotational number of the constant amount pumps when the rotatable valve elements are rotated from an opened state to a closed state such that the pressure detected by the pressure measuring means is constant.

14. The coating apparatus according to claim 13, wherein each of said rotatable valve elements is substantially cylindrical except for said circumferential notch portion which is a substantially flat chordal surface extending axially the length of the elongated width of said ejection ports for allowing said coating solution to flow thereby and through said ejection paths when said rotatable valve elements are positioned within said first angular range.

15. The coating apparatus according to claim 14, wherein said substantially flat chordal surfaces are in alignment with said ejection paths when said rotary valves are open.

16. A coating apparatus for coating opposing sides of a web, traveling in a traveling direction along a transfer path, with a coating solution, comprising:

dies installed on opposing sides of said transfer path;

said dies each including a reservoir for storing the coating solution inside respective ones of said dies;

said dies each having an ejection port with an elongated width along a width direction of the web for ejecting the coating solution;

ejection paths for the coating solution communicating substantially the elongated width of the ejection ports with respective ones of said reservoirs;

coating solution supplying means for supplying a controlled amount of the coating solution to said reservoirs to effect ejection of the coating solution onto opposing sides of the web by ejecting the coating solution respectively from said ejection ports onto the web;

each of said ejection paths having a rotary valve with a rotatable valve element of a substantially cylindrical shape extending parallel to and along a width of the elongated width of the ejection ports which opens said ejection path when positioned within a first angular range and closes said ejection path when positioned within a second angular range;

driving means for pivoting said rotatable valve elements of the rotary valves between said first angular range and said second angular range to provide intermittent flow of said coating solution to apply an intermittent coating to said web;

pressure measuring means for measuring an inner pressure of said reservoirs;

said coating liquid supply means including constant amount pumps for supplying amounts of the coating solution at a constant ejection amount per rotation respectively to said reservoirs; and control means for increasing a rotational number of the constant amount pumps when rotatable valve elements are rotated from a closed state to an opened state and the pressure detected by pressure measuring means is constant.

17. The coating apparatus according to claim 16, further comprising control means for reducing a rotational number of the constant amount pumps when the rotatable valve elements are rotated from an opened state to a closed state such that the pressure detected by the pressure measuring means is constant.

18. The coating apparatus according to claim 17, wherein each of said rotatable valve elements is substantially cylindrical except for said circumferential notch portion which is a substantially flat chordal surface extending axially the length of the elongated width of said ejection ports for allowing said coating solution to flow thereby and through said ejection paths when said rotatable valve elements are positioned within said first angular range.

19. The coating apparatus according to claim 18, wherein said substantially flat chordal surfaces are in alignment with said ejection paths when said rotary valves are open.

* * * * *